US012607023B2

(12) United States Patent
Gill

(10) Patent No.: US 12,607,023 B2
(45) Date of Patent: Apr. 21, 2026

(54) PLASTERBOARD FINISHING TOOLS

(71) Applicant: Tape-Pro Drywall Tools Pty Limited, Burleigh Heads (AU)

(72) Inventor: Thomas Charles Gill, Burleigh Heads (AU)

(73) Assignee: Tape-Pro Drywall Tools Pty Limited, Burleigh Heads (AU)

( * ) Notice: Subject to any disclaimer, the term of this patent is extended or adjusted under 35 U.S.C. 154(b) by 504 days.

(21) Appl. No.: 18/113,276

(22) Filed: Feb. 23, 2023

(65) Prior Publication Data

US 2023/0265665 A1 Aug. 24, 2023

(30) Foreign Application Priority Data

Feb. 23, 2022 (AU) ..... 2022900417

(51) Int. Cl.
*E04F 21/08* (2006.01)
*E04F 21/165* (2006.01)

(52) U.S. Cl.
CPC ..... *E04F 21/08* (2013.01); *E04F 21/165* (2013.01)

(58) Field of Classification Search
None
See application file for complete search history.

(56) References Cited

U.S. PATENT DOCUMENTS 4,208,239 A 6/1980 Lass
4,707,202 A 11/1987 Sweeny
(Continued)

FOREIGN PATENT DOCUMENTS

EP 0 456 435 A1 11/1991

OTHER PUBLICATIONS

Australian Patent Office International-Type Search Report (PCT Article 15(5) corresponding to AU National Application No. 2022900417 dated Sep. 29, 2022.
(Continued)

*Primary Examiner* — Jethro M. Pence
(74) *Attorney, Agent, or Firm* — Jenkins, Taylor & Hunt, P.A.

(57) ABSTRACT

An apparatus for use in drywall plastering, and more specifically for applying a pumpable finishing compound to a surface, is disclosed. The apparatus comprises a receptacle for storing the pumpable compound, an applicator for applying the compound to a surface or feature to which the compound is to be applied, a pump for pumping the compound from the receptacle to the applicator for application to the surface or feature, an electric motor which drives the pump, a battery that powers the electric motor, and a conduit through which the compound is pumped from the receptacle to the applicator, and the receptacle, pump, motor and battery of the apparatus may be able to be worn by a user, or carried on a part of the user's body, while the apparatus is in use for applying the compound to the surface or feature. The apparatus is self-contained and self-powered, and it can consequently operate in an "untethered" manner in the sense that it does not require any power cables extending from the apparatus to a remote power outlet or generator, and there is no need for any hoses or the like to deliver finishing compound, or compressed air, or anything like that, to the apparatus while it is in use.

16 Claims, 27 Drawing Sheets

(56) References Cited

U.S. PATENT DOCUMENTS

| | | | | |
|---|---|---|---|---|
| 5,013,389 | A * | 5/1991 | Retti | E04F 21/1657 156/577 |
| 5,279,684 | A | 1/1994 | Retti | |
| 5,368,461 | A | 11/1994 | Murphy | |
| 5,878,925 | A | 3/1999 | Denkins et al. | |
| 6,294,034 | B1 | 9/2001 | O'Mara et al. | |
| 6,419,773 | B1 | 7/2002 | Lauermann | |
| 8,323,011 | B2 | 12/2012 | Yang et al. | |
| 9,470,228 | B2 | 10/2016 | O'Connor | |
| 9,889,464 | B1 | 2/2018 | Winne | |
| 12,151,222 | B2 * | 11/2024 | Sleightholme | E04F 21/08 |
| 2004/0112982 | A1 * | 6/2004 | Dilley | E04F 21/12 239/152 |
| 2010/0014908 | A1 * | 1/2010 | Campbell | B05C 17/0308 401/146 |
| 2018/0371767 | A1 * | 12/2018 | Swartz | E04F 21/1657 |
| 2024/0131552 | A1 * | 4/2024 | Martin | B05C 1/0813 |

OTHER PUBLICATIONS

European Search Report corresponding to EP Patent Application Serial No. 23157756.0 dated Jul. 13, 2023.

* cited by examiner

Figure 1 - prior art

Figure 2 - prior art

Figure 3 - prior art

Figue 22

PLASTERBOARD FINISHING TOOLS

CROSS-REFERENCE TO RELATED APPLICATION

This application claims priority to Australia Patent Application No. 2022900417, filed Feb. 23, 2022, the disclosure of which is incorporated herein by reference in its entirety.

TECHNICAL FIELD

The present invention relates generally to finishing tools for use in plasterboard (a.k.a. drywall) construction.

BACKGROUND

In plasterboard construction (a.k.a. drywall construction), so-called "plasterboard" panels or sheets (a.k.a. "drywall" panels) are secured to framing to create surfaces of interior walls, ceilings and the like. The individual plasterboard panels (sheets) themselves are typically supplied with dimensions in the order of 3000 mm×1200 mm×10 mm, although panels can of course be supplied in different sizes, and in any case, they are (where necessary) cut to the required size and shape prior to installation. The plasterboard (drywall) panels themselves are made from a layer of gypsum plaster (or similar material) sandwiched between two outer layers of heavy-duty paper (or similar outer surface material). Thus, the internal layer in the panel (which is what provides the panel's rigidity) is already dry/set when the panels are supplied, and before the panels are cut to size (if necessary) and secured to framing to form e.g. part of a wall or ceiling surface. As a result, plasterboard panels are easy to secure in place, typically by simply nailing or screwing them to the underlying wall or ceiling framing.

The fact that the plaster layer within each plasterboard panel is already dry/set (and therefore solid) at the time when the panel is supplied (and before the panel is attached to the framing to form part of the wall or ceiling surface) is also the reason why plasterboard panels are sometimes known by the other common name, "drywall" panels/sheets.

When plasterboard panels are installed, e.g., to create surfaces of interior walls or ceilings (or the like), as described above, there is generally a gap between the edges of two adjacent plasterboard panels, or at least a visible joint or line where the edges of two adjacent plasterboard panels meet or abut or where the edge of a panel meets some other edge or surface. A panel and the adjacent panel, or the panel and whatever other edge or surface the panel abuts with, may both lie in a common plane (such as e.g. where the two panels both form part of the same planar wall or ceiling), or they may meet at an angle to one another thereby forming a corner. Such a corner may be either concave (if the visible angle between the two panels is less than 180°) or convex (if the visible angle between the two is greater than 180°, forming a ridge or the like).

In any case, the gaps or lines between adjoining panels (or between a panel and whatever other edge it is adjacent to or abuts against) need to be filled and covered over as part of the final "finishing" process. This is often important for cosmetic reasons, for example to ensure that any such gaps are filled and covered before the surface is painted (and thus to ensure that the final painted surface has a smooth finish). However, in addition, the filling and covering of gaps or lines between adjacent panels (as part of the finishing process) can also have a reinforcing (and therefore structural) purpose, as discussed below.

From a cosmetic point of view, there can often also be other surface blemishes or imperfections in the surface (e.g. wall or ceiling surface) formed by plasterboard panels, which also need to be covered as part of the finishing process prior to painting. For example, places where nails, screws and the like have been inserted through the plasterboard need to be appropriately covered and smoothed over prior to painting, otherwise the locations of such nails and screws (and the imperfections they create in the overall otherwise smooth plasterboard surface) will remain visible once the surface is painted.

The filling and covering of gaps and joints between adjacent panels, as part of the finishing process, often involves applying tape (often called finishing tape, and typically made of paper) which extends along the gap or joint between two panels, such that the width of the tape spans the gap or joint (i.e. the width of the tape extends across the gap so that the tape covers the gap and adheres to a portion of each panel on either side of the gap). This tape is typically secured in place (both across and along the gap between panels) by an (often gypsum-based) adhesive paste (often referred to as finishing compound, or simply "compound" or "mud"), which is applied in the form of a liquid or paste. This compound is applied to the gap either before the tape is applied, or otherwise at the same time as the tape using an "automatic" taping tool that can apply the compound and the tape to the gap simultaneously. An example of an "automatic" taping tool that can apply the compound and the tape to the gap simultaneously (i.e. at the same time) is shown in FIG. 1(*i*). FIG. 1 also contains a number of other images ((ii)-(vi)) showing the "automatic" taping tool of FIG. 1(*i*) in use, and also (in the case of (v) and (vi)) showing the tape and compound when being applied, and when just applied, to a gap between panels.

Regardless of whether the compound used to secure the tape is applied manually before the tape is then applied, or at the same time as the tape using an automatic taping tool like the one shown in FIG. 1(*i*), the adhesive compound is applied as a liquid/flowable paste, meaning that it enters and fills the gap between the panels, and when it sets (after the tape has been applied), the tape and compound together form a solid (set) join both within and also covering the gap between the panels.

Therefore, as alluded to above, the "taping" of the gaps between panels (as described above), in addition to just covering the gap between adjacent panels for cosmetic purposes (i.e. in addition to allowing a smooth covering to be created over the gap prior to painting), also serves a reinforcing (and therefore structural) purpose. This is because the compound that secures the tape is also squeezed into the gap and therefore it at least partly fills the gap between the panels. Therefore, when the compound that has been squeezed into the gap between panels sets, it helps to join/bond the two panels together, and this helps to reinforce the two panels and the joint between them. Also, the tape (in addition to simply covering the gap) becomes adhered to the compound that sets within the gap, and the tape is also secured to portions of the respective panels on either side of the gap, such that the tape also helps to retain the compound in the gap and to further reinforce the join between the panels.

When finishing tape is used to cover and fill the gap between panels, as described above, and even though excess compound is typically wiped off or otherwise removed before it sets (and the joint may even be sanded to smoothen it after the compound has set), nevertheless there are often still lines or ridges formed by the tape, in particular by the edges of the tape, and the discontinuity between the edges of the tape and the surface of the panel(s) on either side of the tape, which would remain visible when the wall is painted, unless further finishing is performed to hide this. Accordingly, in order to smooth over and hide the existence of the tape (i.e. so that the presence of the tape is not visible/apparent when the surface is finally finished and painted), it is common for a further and wider layer of finishing compound to be applied over the tape, thereby forming an even smoother outer surface over (and covering) the tape (and its edges). This further layer of finishing compound effectively fills in and smoothly covers any remaining edges or discontinuities so that any edges between adjacent plasterboard panels, including edges of the tape (or ridges in, or parts of, the tape etc) are imperceptible once the surface is subsequently (sanded or re-sanded if necessary and then) painted.

This method of applying a layer of finishing compound can also be used directly/by itself, and not just after the application of tape, to smoothen over and hide small imperfections like nail holes, screw holes and the like. In other words, a layer of finishing compound can also be applied directly to the surface to smoothen over and hide nail holes, screw holes and the like.

Traditionally, the task of applying the finishing compound as described above, e.g. either directly to the plasterboard surface to directly cover any imperfections, or over finishing tape to smooth over any ridges or other imperfections associated with the tape, was performed by hand; that is, by a skilled tradesman using a hand tool such as a trowel which the tradesman would first dip into a bucket of the finishing compound in order to scoop a quantity of the compound onto the trowel, and the tradesman would then use the trowel to scrape or smear an appropriately thin/thick layer of the finishing compound onto the wall to create a smooth surface finish.

However, tools for automatically applying finishing compound have also been designed and are now widely used. Such tools are often referred to as "automatic" finishing tools, and the word "automatic" is used here in the sense that the user simply needs to press the tool against the surface and move it along the surface, and when this is done the tool operates to automatically cause a thin layer of finishing compound to be applied to the surface as it moves (rather than the thin layer of compound being formed through the skill of the tradesman using a simple hand trowel to apply the compound to the surface).

The example taping tool shown in FIG. 1(*i*) is also a form of "automatic" tool (it is an automatic taping tool) because, in use, the user simply needs to press the end of this taping tool (thereby also pressing the tape that is being applied to the surface) against the surface and move the tool along the surface. When this is done, the tool operates to automatically cause compound (which is also stored within the tool) to be dispensed from the end of the tool and onto the tape. More specifically, as the user moves the tool along the surface, the tool automatically causes compound to be applied onto one side of the tape (the side of the tape that becomes stuck to the surface) as the tape passes over the tool head. Therefore, as the tape passes over the tool head and off the tool as the tool moves, the tape (with the compound then applied to the side that contacts and adheres to the surface) is pressed against the surface by the tool's rollers which roll along the surface, thereby pressing the tape (with the compound applied to it) that is coming off the tool against the surface as the tool moves.

Importantly, as the tool in FIG. 1(*i*) moves, thereby causing the tape (with compound applied to it) to be pressed against the surface, the compound that is applied to the tape before the tape is pressed onto the surface consequently gets pressed into (and therefore at least partially fills) the gap between panels. Also, it is important to note that, although the rate at which the tape is applied to the surface is determined by the speed with which the user moves the tool head along the surface, the tool automatically operates to dispense the compound in the correct amount (or at the correct rate) according to the speed at which the user is moving the tool along the surface.

With the automatic taping tool in FIG. 1(*i*), just before (often about e.g. 100 mm before) the user reaches the place where the application of tape and compound is to finish, the user actuates a tape cutting mechanism on the tool which cuts the tape, but leaves a short length (approx. 100 mm) of tape remaining to be applied by the tool, and after that the user continues to move the tool along for the remaining distance to apply the remaining amount of tape (and the compound thereon) to the surface, and thereafter the user then lifts the tool away from the surface. FIG. 1(*v*) and (vi) are images which show "before" and "after" these final steps.

The operation of the automatic taping tool shown in FIG. 1(*i*) is described and shown in more detail in the video which can be viewed at: https://www.youtube.com/watch?v=XLME7cVrInA. However, in brief terms, it can be seen from FIG. 1(*i*) that there are a number of (in this case three) circular (disc-like) rollers at the head of the tool. When the tool is in use, as mentioned above, the user presses the head of the tool against the surface. More specifically, when the user presses the head of the tool against the surface, the paper tape that is being dispensed by the tool, and specifically the portion of the tape which is at that time passing over the tool head, is pressed against the surface by the rollers. Therefore, when the user presses the end of the tool against the surface, the user is actually pressing the rollers against the tape which is passing over and off the tool head, such that the tape passing over and off the tool head is actually pressed against the surface by the rollers. In other words, as the user moves the tool head along the surface, the rollers roll along pressing the tape (which is coming off the tool) against the surface. It should also be noted that the tape which is being pressed against the surface by the rollers will (by then) already have had the compound dispensed onto the side thereof which subsequently contacts the surface, such that when the user presses the tool against the surface and moves the tool along the surface, the rollers press against and roll along the tape thereby pressing the tape, and also the compound which is applied to the opposite side of tape, against the surface (and this also helps to squeeze some of the compound into the gap between the panels).

In any case, it can be seen from e.g. FIG. 1(*iii*) that the tool is able to receive and mount a roll of the paper tape (the roll of tape is mounted towards the lower end of the tool, just above the user's right-hand in FIG. 1(*iii*)), and as the tool is used (as the head of the tool is moved along the surface, as described above), the tape unrolls from the roll and is fed up through a tape guide just below the tool head and then over and off the tool head.

It can also be seen in FIG. 1(*i*) that the tool incorporates a chain. The chain also forms part of the tool head and there are number of mechanisms linked to (and driven by) the chain. These are not all fully shown in FIG. 1(*i*), but their general operation will now be described briefly.

The chain is connected to the above-mentioned rollers on the head of the tool such that, as the rollers roll over the tape as the tool moves along the surface, the rotation of the rollers (in addition to pressing against the tape, etc, as described above) also causes the chain to rotate/circulate on the tool. In other words, the circulation of the chain on the tool head is driven by rotation of the rollers (as the tool head is moved along the surface). One of the mechanisms which is connected to (and driven by) the chain (although it is not visible in FIG. 1(*i*)) is a piston. Basically, the chain connects to (and drives rotation of) drive wheels which are located within the head of the tool, and the rotation of these drive wheels in turn causes the piston, which is within the tool, to move towards the head end of the tool. This movement of the piston within the tool causes the compound to be dispensed at the head end of the tool (it is dispensed onto the tape as the tape passes over the tool head) at a rate determined by (and appropriate for) the rate at which the rollers are moving (i.e. the compound is dispensed at a rate appropriate for (and determined by) the speed at which the tool is being moved, such that the compound is dispensed onto the tape at a rate appropriate for the speed at which the tape is being applied to the surface by the tool).

As explained above, when tape is used to cover and fill the gaps between panels, there are often still lines or ridges formed by the tape, and therefore in order to smooth over and hide the existence of the tape (i.e. so that the presence of the tape is not visible/apparent when the surface is finally finished and painted), it is common for a further and wider layer of finishing compound to be applied over the tape too, thereby forming an even smoother outer surface over the tape. It is also explained above that a layer of finishing compound can also be applied directly/by itself onto the surface to smoothen over and hide small imperfections like nail holes, screw holes and the like.

An example of one type of automatic finishing tool which is currently used for this purpose (i.e. for applying a thin layer of finishing compound) on flat/planar surfaces is given in FIG. 2(*i*). As shown in FIG. 2(*ii*) and (iii), the automatic finishing tool in FIG. 2(*i*) can be mounted on the end of a handle, which may be either a short handle as shown in FIG. 2(*ii*) or a longer handle as shown in FIG. 2(*iii*). Handles such as the longer one shown in FIG. 2(*iii*) are often used where the finishing compound needs to be applied at a height where the user could not easily (or as easily) press the tool firmly against the plasterboard surface without the assistance of the handle. Such longer handles are also often employed for applying finishing compound to ceilings and the like.

An example of another type of finishing tool, which is currently used for applying finishing compound to gaps in internal/concave corners, and also to gaps on external/convex corners or ridges, is given in FIG. 3. As can be understood from FIG. 3(*i*) and (ii), this finishing tool has an internally hollow outer casing that can be filled with the compound, and there is a hand-operated plunger handle with a piston on its inner end which can be used (by the user, by hand) to force compound out of the hollow casing through the nozzle on the opposite end of the tool. Also, as shown in a number of the images in FIG. 3, different fittings can be connected to the externally-round (but internally hollow) metal connector located on the tip of the nozzle of the tool. These different attachments can enable the tool to apply finishing compound in different situations or ways. For example, the images in FIG. 3(*iii*) and (iv) show the tool with a glazer attachment connected thereto, which enables compound (which is pumped from within the tool) to be applied to an internal corner, as shown in FIG. 3(*v*). The image in FIG. 3(*vi*) shows the tool with another kind of attachment that enables compound to be pumped from within the tool and applied to an internal corner, as shown in FIG. 3(*vii*). FIG. 3(*viii*) shows the tool with yet another attachment which, in use, enables compound to be applied to a gap between panels on external (convex) corner or ridge.

Automatic finishing tools like the ones shown in FIG. 1, FIG. 2 and FIG. 3 generally work well, are also comparatively inexpensive, and are consequently widely used. However, certain disadvantages associated with such tools arise as a result of the fact that the finishing compound which is applied to fill the gap and secure the tape (in the case of taping tools like the one in FIG. 1), or which is applied directly to the wall or ceiling surface (like in the case of the tools in FIG. 2 and FIG. 3), is contained within the tool itself. In other words, the tool must initially be filled with finishing compound (this is done by e.g. simply scooping or pouring the finishing compound into the tool manually (as shown for example in FIG. 2(*v*)), or otherwise by pumping the finishing compound into the tool from a bucket or drum or vat or the like) and the user must then carry the filled tool to the location where it is to be used to apply the compound (along with the tape, or by itself) to the plasterboard. As a result, the amount of finishing compound that can be applied before all of the compound held within the tool is used up, and hence the amount of time that the user can work before the compound in the tool runs out and the user must return to refill the tool again, is limited by the size of the tool's receptacle which contains the compound.

However, it is not possible to simply increase the size of the tool's receptacle that contains the compound in order to reduce the frequency with which the user must return to refill the tool, at least not beyond a certain point. The reason is because, if the size of the tool's receptacle for containing the compound is made too large, the weight of the compound in the tool (especially when the tool is completely filled), together with the weight of the tool itself (which also generally increases with increased receptacle size), would become too heavy for the tool to be practical to use. This is especially so given that users (typically plasterers or similar tradesman) must often use such tools for extended periods (i.e. for hours on end, day after day). Thus, the weight of the tool (both when filled with compound, and the weight of the tool generally) must not be too high because, the heavier the tool, the greater the rate of fatigue for the user, and also the greater the risk of injury. (Fatigue, and injury risk, are particularly pronounced for the arms and upper body which bear the weight of these kinds of tools.)

These weight-related issues associated with existing automatic finishing tools can be particularly significant when the tools are used on the end of a long handle, or otherwise at a distance away from, or above, the user's body, because, in such cases, the user is (and in particular the user's arms and upper body are) required to bear the weight of the heavy tool (and also apply pressure to press the tool against the wall etc.) while the weight of the heavy tool is held out at a distance away from the user's body or on the end of the handle. This can create stresses and fatigue on the user's arms and upper body in particular.

Therefore, in practice, even with the automatic finishing tools which are currently in use (e.g. like the ones described above, and others), which typically have relatively small receptacles for receiving and containing the finishing compound, the weight of these makes them strenuous and tiring to use over extended periods.

Accordingly, because it is not possible (at least not beyond a certain point) to reduce the frequency with which the user must return to refill the tool by increasing the size of the receptacle within the tool that holds the finishing compound, and because the size of the receptacle (and hence the amount of finishing compound that the tool can hold at any time) is consequently limited, a downside associated with these kinds of "batch fill" automatic finishing tools (they are referred to as "batch fill" tools because the tools are filled, and successively refilled, etc, in batches), examples of which are shown in FIG. 1, FIG. 2 and FIG. 3, is that the user must frequently return and refill the tool, meaning that a lot of time is often wasted refilling the tool and also walking between the refilling location and the location where the tool is being used. Plus, even with existing types of these tools for which the size of the receptacle (and hence the weight of the tool) is limited to a manageable level, the tools are still sufficiently heavy that they become strenuous and tiring to use over extended periods.

A company called Apla-Tech, Inc. has developed a system called the Continuous Flow Finishing System or CFS. In this Apla-Tech, Inc. system, the finishing compound which is applied to the wall or ceiling surface (or the like) is not stored within the tool itself. Rather, a large, floor-mounted hopper containing a large amount of finishing compound is provided (i.e. the finishing compound in the hopper is mixed and ready to be used), and there is a hose leading from the hopper to the tool. A mains (or AC) powered pump is also provided (mounted to or adjacent the hopper), which the user can control via a trigger on the tool handle. In order to apply the finishing compound to the wall with this system, the user simply presses the tool against the wall and then squeezes the trigger, whereupon the finishing compound is pumped from the hopper, through the hose and into the tool, and the tool then causes a thin layer of the compound to be applied to the surface.

One advantage of this system is that the user is not required to repeatedly return and refill the tool each time the tool's own internal containment receptacle runs out. Also, with this system, the weight of the system components which must be borne by the user is often not as great as for the "batch fill" types of tools discussed above. This is because, in this pumped continuous flow system, the user is only required to lift and bear the weight of the tool along with the weight of the small amount/length of hose that extends between the tool and the ground (when the tool is being held and used above the ground) plus the weight of the finishing compound that is in the tool and in this length of hose, from time to time. Generally, the weight of this will be less than the weight of the kind of "batch fill" automatic finishing tools described above, particularly when such "batch fill" tools are fully loaded.

However, there are also a number of problems associated with the Apla-Tech, Inc. Continuous Flow Finishing System just described and also with other systems similar to it. For example, this system (and others like it) necessarily requires a large hopper filled with finishing compound which, due to its size and weight (particularly when filled with a large amount of the finishing compound), must be placed on the ground and remain stationary (i.e. it must stay in one place and cannot be easily moved). This hopper (particularly when filled with or containing compound), together with the associated pump which is attached to or mounted with the hopper, is heavy and difficult to move. The pump itself is also very large and heavy, because a large pump is required to provide sufficient power to pump the finishing compound through the length of hose which leads from the hopper to the location where the tool is being used (which may be 10 m or more, i.e. the length of those may be 10 m or more). This can create difficulties where, for example, on a particular job site there is a need to perform finishing on walls or ceilings over a large area or at different locations, not all of which can be reached while the hopper remains in a single location given the limited length of the hose. (The length of the hose is limited by, among other things, the power/pumping capacity of the pump.) Thus, there may be a need to move the hopper and pump from one location to another in order to perform the required surface finishing at all locations, and moving the heavy hopper and pump can be difficult. The weight of the hopper and pump, and the difficulties associated with moving them, can be a particular problem, for example, on multilevel jobsites (especially if there is no lift or elevator) because in such cases, if there is a need to apply the finishing compound to wall ceiling surfaces on different levels, the heavy hopper and pump must be moved/carried (e.g. up the stairs).

Furthermore, due to the large amount of power required to drive the pump which pumps the compound from the hopper to the tool, the pump used in the Continuous Flow Finishing System described above (and others like it) is required to be powered by either mains AC power, or otherwise by equivalent power from a generator. Accordingly, this system can only be used either, in places (i.e. on sites) that have ready access to mains power, or otherwise a separate generator must be used (which is an additional heavy, difficult to move piece of equipment). It may not always be the case that mains power is available on all jobsites. Indeed, there may be a number of reasons why mains power may not be available on a particular site. For example, the electrical wiring or other works required for this may not yet have been completed, etc. Where this is the case, a generator must be employed, or this Continuous Flow System cannot be used.

Yet another problem associated with the pumped continuous flow system described above is that the hose which conveys the finishing compound from the hopper to the tool must be fairly long (typically as long as the pumping capacity of the pump will permit, often over 10 m) in order to enable surface finishing to be performed at distances as far from the hopper and pump as possible. In other words, the longer the hose, the further away from the hopper and pump it is possible to perform finishing tasks without having to move the hopper and pump. However, this in turn means that there is invariably a long hose (or possibly multiple such hoses if multiple of such systems are in use simultaneously) and this hose (or these hoses) can snake through and around the jobsite, creating trip hazards or potentially knocking over other equipment, etc. Or, when finishing work is being performed close to the hopper and pump, the long length of hose may collect or gather up (or form disorderly loops or tangles, etc) at or around the feet of the worker, again creating a potentially severe trip hazard and/or making the work more difficult. Any power cables leading to the pump (e.g. from a mains power outlet, or from a generator) may also pose a trip hazard.

The continuous flow systems described above are also comparatively much more expensive than the kinds of "batch fill" automatic finishing tools described earlier. As a result, the use of these continuous flow systems is generally only economical on large job sites where the amount of drywall finishing required is large.

A small number of other systems have also previously been proposed for use in these kinds of drywall finishing applications, but these generally suffer from similar problems to those described above.

For example, U.S. Pat. No. 5,279,684, assigned to Drywall Technologies, Inc., discloses an apparatus in which a container of finishing compound is able to be carried by a user, and the user also carries a finishing tool for applying the compound to the surface, and the apparatus includes pumps for pumping the finishing compound from the user-carried container to the user-carried tool for application to the surface. The pumps of the apparatus in U.S. Pat. No. 5,279,684 are driven by electric motors, and the electric motors are driven by a 120 V electrical supply. The electric motors in U.S. Pat. No. 5,279,684 therefore require a mains electric power supply or possibly a generator able to generate an equivalent power supply (e.g. at the same voltage etc as the mains). Consequently, whenever the apparatus in U.S. Pat. No. 5,279,684 is in use, an electrical cable is required to extend between the user's location and the location of the electric power supply (mains socket or generator) that is supplying the electrical power to the apparatus' electric motors. This in turn means that there is invariably a long power cord (or possibly multiple such cords if multiple of such apparatus are in use simultaneously) and this cord (or these cords) can snake through and around the jobsite, creating trip hazards, or knocking over other equipment, etc. Also, when finishing work is being performed close to the electrical power supply (mains outlet or generator), the long cord may collect or gather up (or form disorderly loops or tangles, etc) at or around the feet of the worker, creating a trip hazard and/or making the work more difficult. And again, the apparatus in U.S. Pat. No. 5,279,684 can only be used either, in places (i.e. on sites) that have ready access to mains power, or otherwise where a generator can be used (which is an additional heavy, difficult to move piece of equipment). As mentioned above, it may not always be the case that mains power is available on all jobsites.

Another example is U.S. Pat. No. 4,208,239, assigned to Corban Industries, Inc., which discloses an apparatus in which a container of finishing compound is able to be carried/worn by a user, and the user also carries a finishing tool for applying the compound to the surface. The compound is conveyed from the user-carried container to the tool via a tube. The apparatus in U.S. Pat. No. 4,208,239 relies upon pressurised air at a pressure of 35-40 psi to deliver the finishing compound from the user-carried container to be finishing tool. This compressed air is supplied to the user-carried apparatus by a hose. Thus, one end of this hose carrying compressed air connects to the user-carried apparatus while the other end connects to an air compressor, which is a large, heavy and immovable (or difficult to move) piece of equipment. Consequently, with the apparatus in U.S. Pat. No. 4,208,239, a hose carrying compressed air is required to extend between the user's location and the location of the air compressor that is supplying the pressurised air. This in turn means that there is invariably a long hose (or possibly multiple such hoses if multiple of such apparatus are in use simultaneously) and this hose (or these hoses) can snake through and around the jobsite, creating trip hazards, or knocking over other equipment, etc. Also, when finishing work is being performed close to the air compressor, the long hose may collect or gather up (or form disorderly loops or tangles, etc) at or around the feet of the worker, creating a trip hazard and/or making the work more difficult. And again, the apparatus in U.S. Pat. No. 4,208,239 can only be used in places there is an air compressor or where an air compressor is able to be used.

Further examples include the systems disclosed in U.S. Pat. Nos. 6,294,034 and 6,419,773, both of which again require a long hose to convey compound from a receptacle in which the compound is contained to the location (some distance away from the receptacle) where the tool is in use. Hence, in these systems also, the hose extends all the way from the location where the receptacle containing the compound is located to the location where the tool is in use.

It is to be clearly understood that mere reference in this specification to any previous or existing devices, apparatus, products, systems, methods, practices, publications, patents, or indeed to any other information, or to any problems or issues, does not constitute an acknowledgement or admission that any of those things, whether individually or in any combination, formed part of the common general knowledge of those skilled in the field or is admissible prior art.

SUMMARY OF THE INVENTION

In one form, albeit not necessarily the only or broadest form, the invention resides in an apparatus for use in drywall plastering for applying a pumpable finishing compound, the apparatus comprising

- a receptacle for storing the pumpable compound,
- an applicator for applying the compound to a surface or feature to which the compound is to be applied,
- a pump for pumping the compound from the receptacle to the applicator for application to the surface or feature, and
- a conduit through which the compound is pumped from the receptacle to the applicator, wherein at least the receptacle of the apparatus is able to be worn by a user, or carried on a part of the user's body, while the apparatus is in use for applying the compound to the surface or feature.

In this form of the invention, the apparatus may further include one or more straps which enable at least the receptacle of the apparatus to be worn by the user or carried on a part of the user's body. In some particular embodiments, the apparatus may include a pair of shoulder straps which enable at least the receptacle of the apparatus to be worn like a backpack. In other possible embodiments, the apparatus may be configured such that at least the receptacle is able to be carried in a manner similar to a duffel bag or the like (or carried or "slung" over one shoulder).

The conduit through which the compound is pumped from the receptacle to the applicator may include a flexible hose. Also, the applicator for applying the compound to the surface or feature may comprise (or it may at least include) a finishing tool (such as e.g. a flat applicator tool for applying the compound to a flat surface, or a tool for applying compound to a corner, etc). Thus, the applicator may comprise (or at least include) a finishing tool for applying the compound to a flat surface, or for applying the compound to a concave (internal) corner where two surfaces meet, or for applying the compound to a convex (external) corner or ridge where two surfaces meet. The applicator may also or alternatively comprise a taping tool for applying the compound and finishing tape simultaneously.

The apparatus may include a handle through which the compound can be pumped, and the tool may be mounted on one end of the handle such that pumped compound is delivered to the tool via the handle. In embodiments where this is the case, one end of the hose may be connected to the pump and the other end of the hose may be connected to the opposite end of the handle from the tool.

The receptacle of the apparatus may be elongate in shape and is oriented so that its long dimension is substantially (or at least generally) vertical when the apparatus is being worn or carried by the user. The receptacle may also have a lower end which is closed except for an outlet through which the compound can flow when it is pumped out of the receptacle, and the apparatus may further include a piston inside the receptacle, and the compound in the receptacle may be between the lower end of the receptacle (which is below the compound) and the piston (which is above the compound), and as compound is pumped out of the receptacle and the level of compound within the receptacle drops, the piston may move down and remains in contact with the compound from above.

The apparatus may further include a motor for driving the pump. The motor may be an electric motor. The motor may also be mounted to, or relative to, the receptacle such that the motor is also a part of the apparatus which is worn by the user or carried on a part of the user's body.

Where the motor of the apparatus is an electric motor, the apparatus may further include a battery for powering the electric motor. The battery may be mounted to, or relative to, the receptacle such that the battery is also a part of the apparatus which is worn by the user or carried on a part of the user's body.

The pump of the apparatus may be mounted to, or relative to, the receptacle such that the pump is also a part of the apparatus which is worn by the user or carried on a part of the user's body.

Thus, in some embodiments, the apparatus for use in drywall plastering, for applying a pumpable finishing compound, may comprise a receptacle for storing the pumpable compound, an applicator for applying the compound to a surface or feature to which the compound is to be applied, a pump for pumping the compound from the receptacle to the applicator for application to the surface or feature, an electric motor which drives the pump, a battery that powers the electric motor, and a conduit through which the compound is pumped from the receptacle to the applicator, and the receptacle, pump, motor and battery of the apparatus may (all) be able to be worn by a user, or carried on a part of the user's body, while the apparatus is in use for applying the compound to the surface or feature. It will be appreciated that, in such embodiments, the apparatus may be self-contained and self-powered, and it may consequently be able to operate in an "untethered" manner. The operation of the apparatus may be said to be "untethered" in the sense that it does not require any power cables extending from the apparatus to a remote power outlet or generator, and there is no need for any hoses or the like to deliver finishing compound, or compressed air, or anything like that, to the apparatus while it is in use. Consequently, many of the problems with the continuous flow system and other powered/pressurised systems described in the Background section above, many of which were related to the fact that those systems required power cables to supply mains power and/or hoses to deliver finishing compound or compressed air from some remote location, and including the fact that that aspect of the design of those systems can lead to trip hazards and it also restricts the way in which the device can be used, or how far the user could move when using the device, etc, do not apply.

In some embodiments, the pump of the apparatus may be a lobe pump which has a pair of lobes that rotate in opposite directions within a chamber inside the pump so as to pump compound that enters the pump from the receptacle into the conduit that leads to the applicator.

In some embodiments, the apparatus may be configured such that the orientation of a tool which is on the end of the handle is able to be adjusted relative to the handle. In such embodiments, the apparatus may also include a brake mechanism which normally does not hold the tool in a fixed position/orientation relative to the handle, but which can be engaged by the user to hold the tool in a fixed orientation relative to the handle. In some embodiments, the brake mechanism may be operable by a brake lever, and when the brake lever is operated to engage the brake mechanism, a camming mechanism may be engaged to cause a part of (or a part which is associated with) the tool (or a part of the apparatus to which the tool connects) to press against a part of (or a part associated with) the handle, thereby causing the tool to be held in a fixed orientation relative to the handle.

In another form, albeit (again) not necessarily the only or broadest form, the invention resides in an apparatus for use in drywall plastering for applying a pumpable finishing compound, the apparatus comprising

- a receptacle for storing the pumpable compound,
- an applicator for applying the compound to a surface or feature to which the compound is to be applied,
- a pump for pumping the compound from the receptacle to the applicator for application to the surface or feature, and
- a conduit through which the compound is pumped from the receptacle to the applicator, wherein the pump is a lobe pump which has a pair of lobes that rotate in opposite directions within a chamber inside the pump so as to pump compound that enters the pump from the receptacle into the conduit that leads to the applicator.

In this form of the invention, the apparatus may again include one or more straps which enable at least the receptacle and the pump of the apparatus to be worn by the user or carried on a part of the user's body.

In yet another form, albeit (again) not necessarily the only or broadest form, the invention resides in a pump for use in an apparatus for applying a pumpable drywall finishing compound, the pump comprising a lobe pump which has a pair of lobes that rotate in opposite directions within a chamber inside the pump so as to pump compound that enters the pump from an inlet of the chamber to an outlet of the chamber.

In yet another form, albeit (again) not necessarily the only or broadest form, the invention resides in an apparatus for use in drywall plastering for applying a pumpable finishing compound, the apparatus comprising

- a receptacle for storing the pumpable compound,
- a tool for applying the compound to a surface or feature to which the compound is to be applied,
- a pump for pumping the compound from the receptacle to the tool for application to the surface or feature,
- a conduit and a handle through which the compound is pumped from the receptacle to the tool, wherein

- the tool is mounted on one end of the handle,
- one end of the conduit is connected to the pump and the other end of the conduit is connected to the opposite end of the handle from the tool, and
- the orientation of the tool on the end of the handle can be adjusted.

Features described in connection with one form of the invention above may also be used or incorporated in other forms of the invention.

Other features and aspects of the invention will be made evident from the Detailed Description below.

BRIEF DESCRIPTION OF THE FIGURES

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description makes reference to a number of Figures as follows:

In FIG. 2(*iii*), the tool is being used mounted on the end of a longer handle, and the tool is being moved in a direction along a wall toward the corner where that wall joins to the adjacent perpendicular wall. It can just be made out in FIG. 2(*iii*), and it is more clearly shown in FIG. 2(*ii*), that behind the tool (i.e. in the area to the right-hand side of the tool in FIG. 2(*iii*) and (ii)) there is a layer of finishing compound that has been applied by the tool to cover and smooth over any ridges or blemishes associated with the tape. The areas of the tape etc which have not yet had the finishing compound applied to them by the tool can be seen in FIG. 2(*ii*) and also on the adjoining perpendicular wall in FIG. 2(*iii*). The other images in FIG. 2 illustrate the tool itself, including how it can be opened in order to be refilled with compound and cleaned.

FIG. 15 is almost identical to FIG. 14, except that in FIG. 15 the handle's outer elongate cylindrical casing, and also the outer casing component on the brake lever end of the handle, have both been removed so as to reveal and make visible the (right angled) pipe fittings through which the finishing compound flows from the hose and into the handle (and the compound then flows along the inside of the handle and into the tool to be applied to the surface).

FIG. 16 is actually similar to FIG. 14, except that it shows the handle from a different point of view.

FIG. 17 is similar to FIG. 15, except that it shows the handle from the same point of view as FIG. 16.

FIG. 20 shows this portion of the handle from a slightly different orientation and certain parts/components on the end of the handle are made to appear transparent in FIG. 20 in order that other parts and components may be seen.

FIG. 21 shows the tool-end of the handle from a different point of view, including so that the opening through which the finishing compound exits the handle and enters the tool can be seen.

Figure 23:
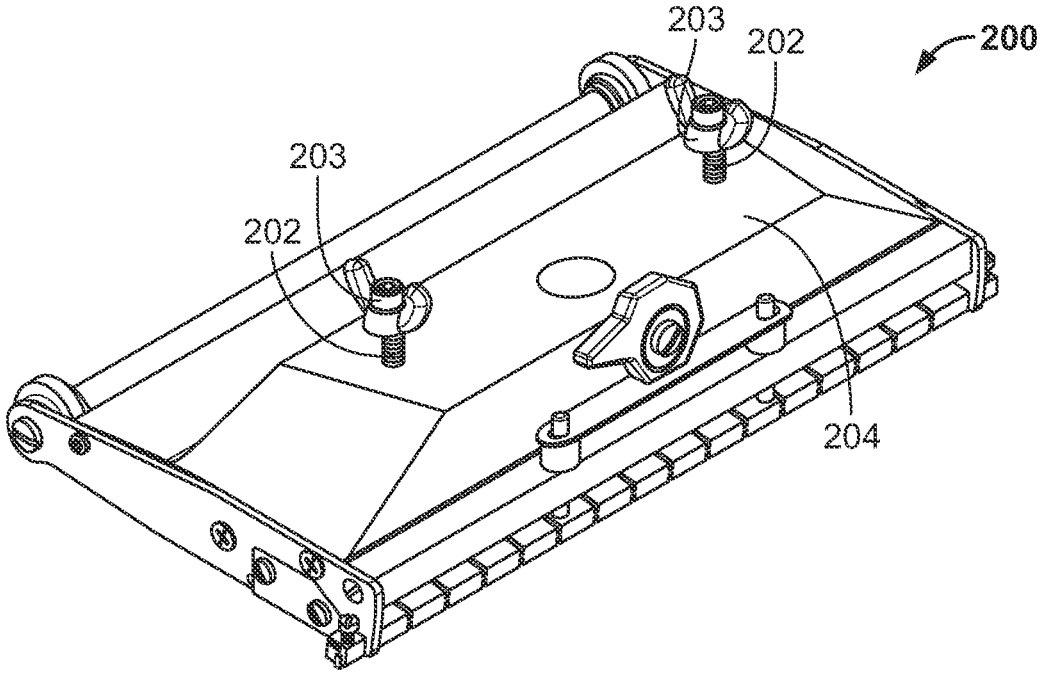
FIG. 23 is a perspective view of a flat applicator tool, which may be attached to the tool mounting plate on the end of the handle. The particular flat applicator tool shown in this Figure is actually the same flat applicator tool as is shown mounted on the end of the handle in a number of the earlier Figures. However, it is to be understood that this is not the only kind of tool that can be mounted on the end of the handle.
Figure 24:
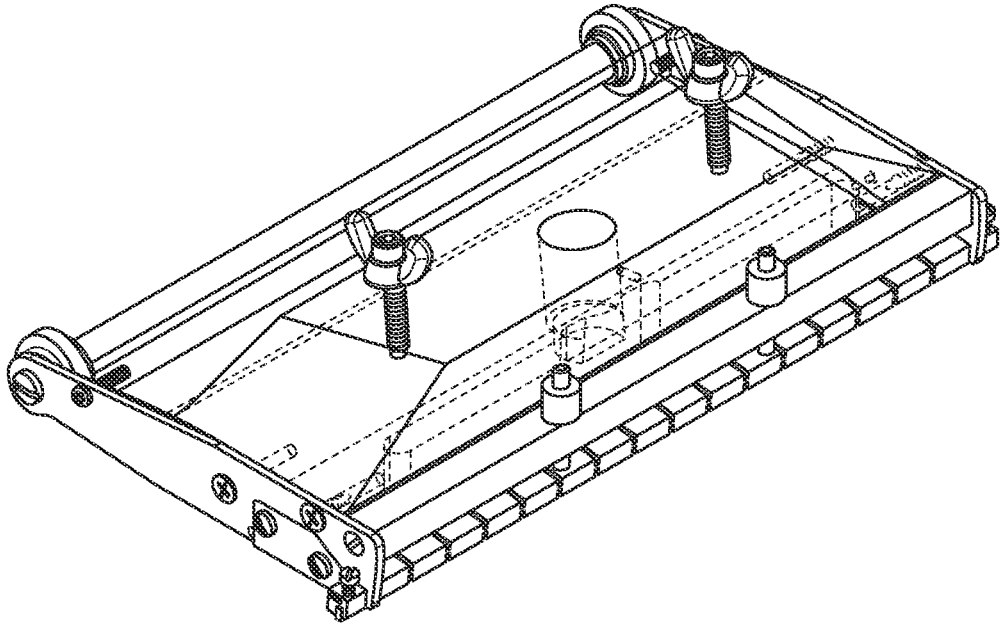
FIG. 24 shows the same flat applicator tool as FIG. 23, and it is shown from the same point of view as in FIG. 23.

However, FIG. 24 differs from FIG. 23 in that, in FIG. 24, the main body part of the flat applicator tool has been made to appear transparent so that the shape of certain internal features thereof can be seen.

Figure 25:
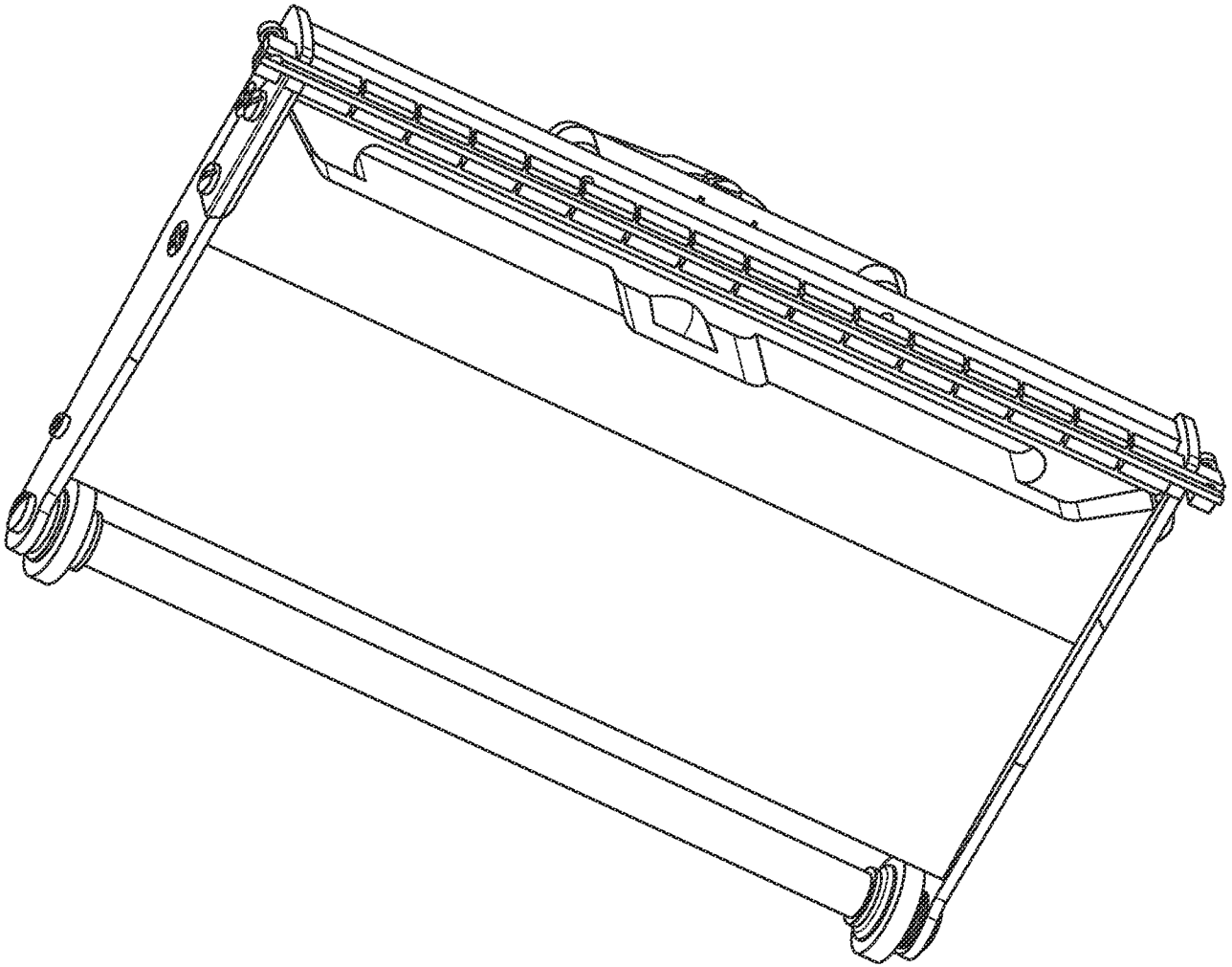

FIG. 25 is another view of the same flat applicator tool as in FIG. 23, but from the underside thereof.

Figure 3:
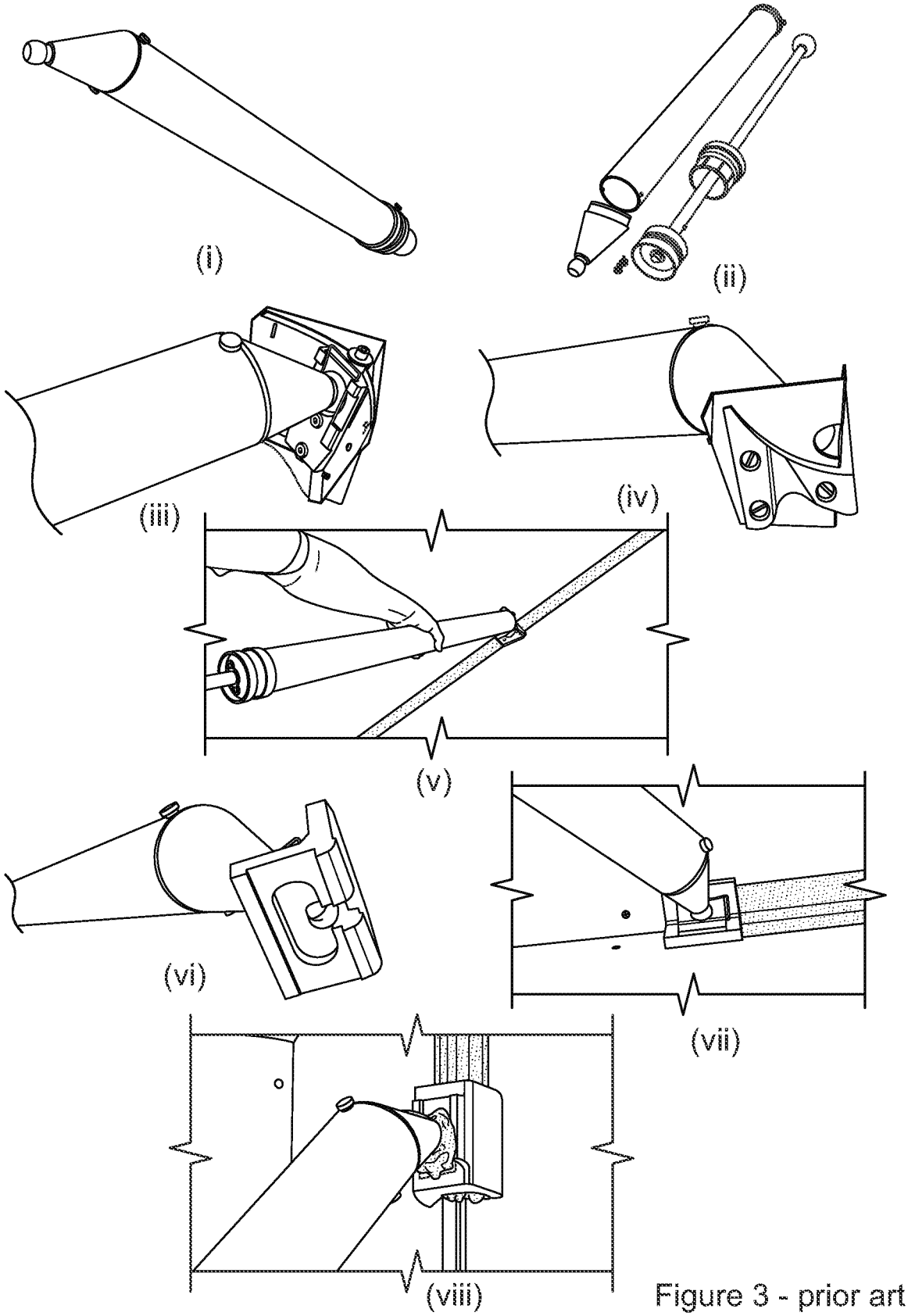
FIG. 3 contains a number of images which illustrate another type of existing finishing tool used for applying finishing compound to gaps in internal/concave corners, and also to gaps on external/convex corners. The various images in FIG. 3 are explained in more detail in the Background section above.
Figure 26:
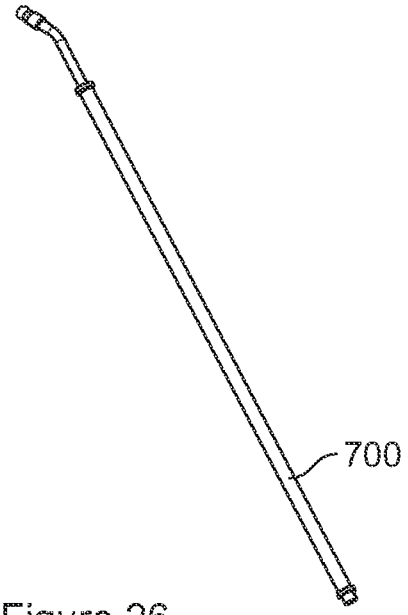
Figure 27:
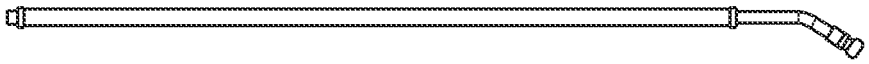
Figure 28:
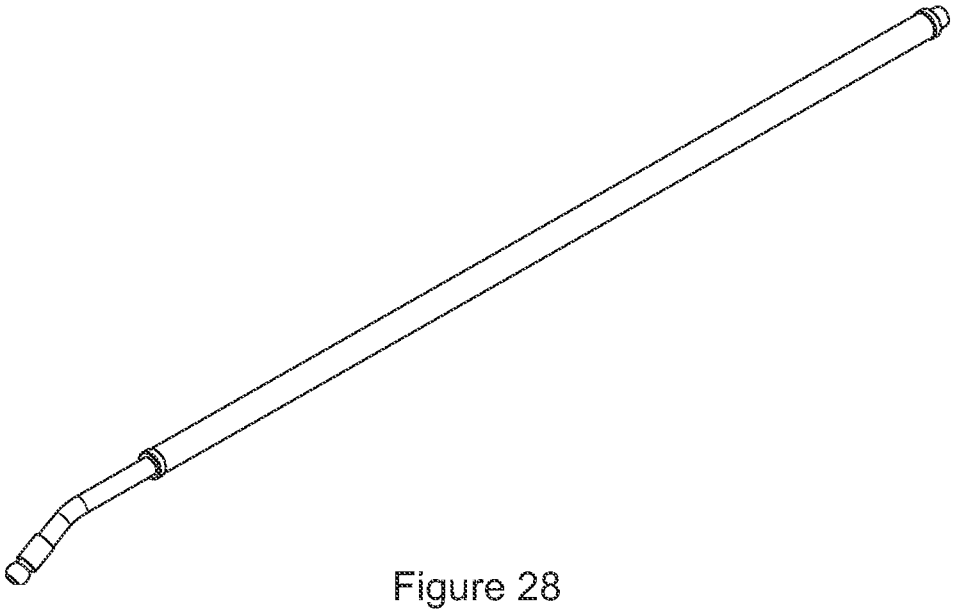

FIG. 26, FIG. 27 and FIG. 28 each show an alternative type of handle that may be used in embodiments of the present invention. The handle shown in these Figures is therefore different from the handle shown in earlier Figures, in particular, in that this handle does not allow a flat applicator tool to be mounted thereto. Instead, the handle shown FIG. 26, FIG. 27 and FIG. 28 is used in situations similar to the situations in which the tool shown in the images of FIG. 3 would be used. Accordingly, similar to the tool shown in FIG. 3, different fittings/attachments can be connected to the externally-round (but internally hollow) metal connector located on the tip end of handle shown in FIG. 26, FIG. 27 and FIG. 28. In fact, the fittings/attachments that can be connected to this handle may be similar to, or the same as, the ones that can be connected to the tool shown in FIG. 3, and these different attachments can be used to apply finishing compound in different situations or ways.

Figure 29:
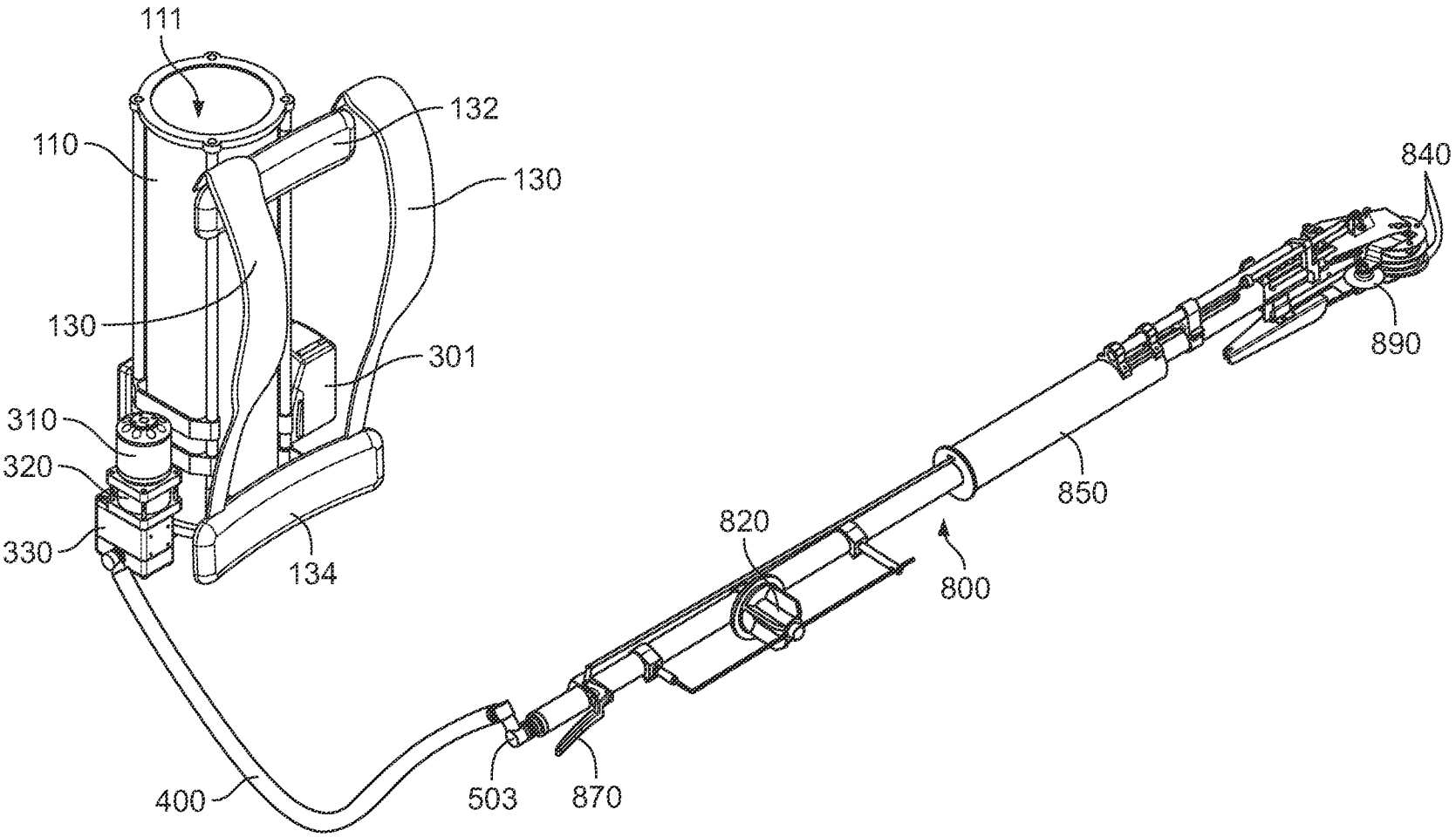

FIG. 29 shows wearable apparatus in accordance with a different embodiment to the one shown in FIG. 4 to FIG. 18. Actually, the wearable apparatus in the embodiment shown in FIG. 29 is similar to the embodiment shown in FIG. 4 to FIG. 18, except that the handle and flat applicator tool which form part of the embodiment shown in FIG. 4 to FIG. 18 are replaced by a taping tool in the embodiment in FIG. 29.

Figure 30:
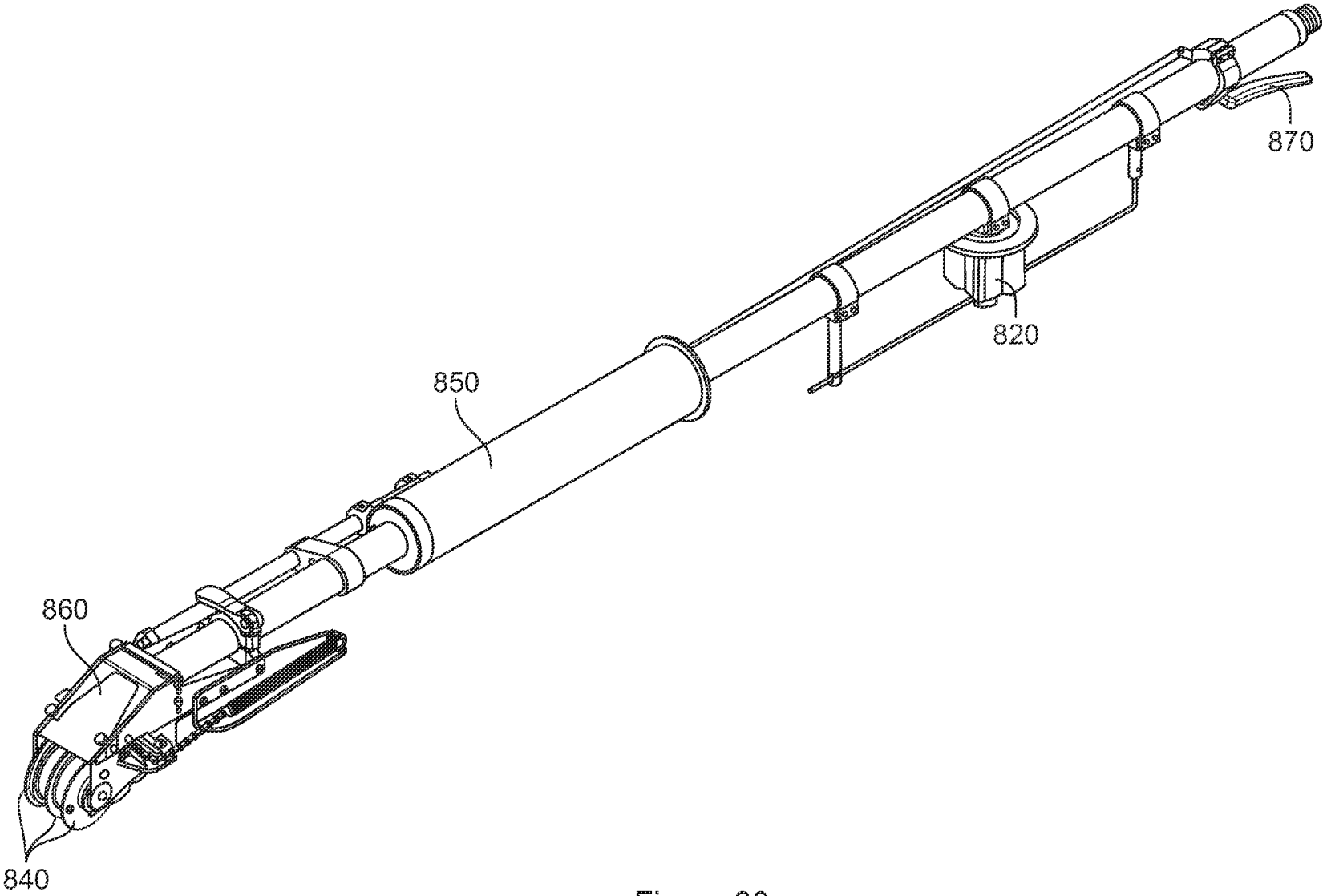

FIG. 30 is a first view of the taping tool in the embodiment in FIG. 29.

Figure 31:
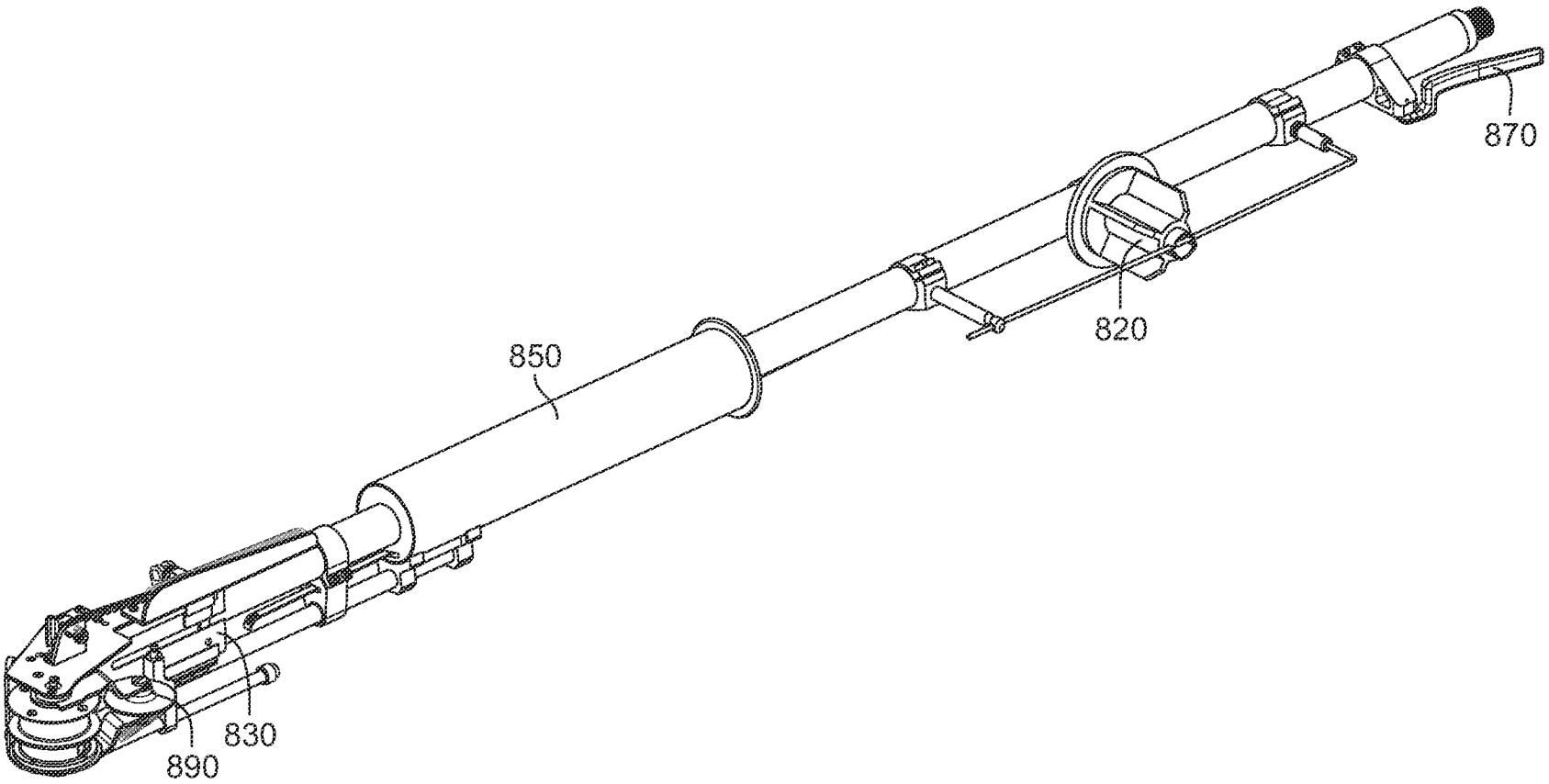

FIG. 31 is another view of the taping tool in the embodiment in FIG. 29 (from a different point of view).

Figure 32:
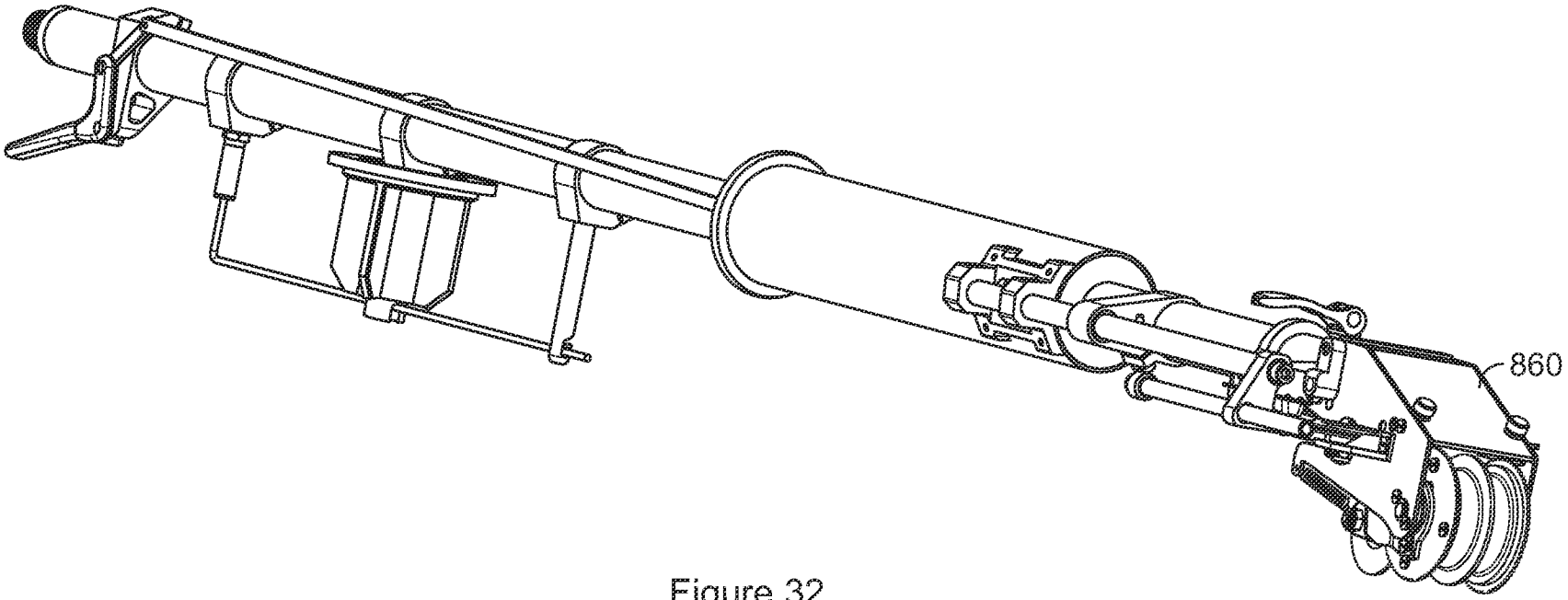

FIG. 32 is yet another view of the taping tool in the embodiment in FIG. 29 (from a different point of view again).

Figure 33:
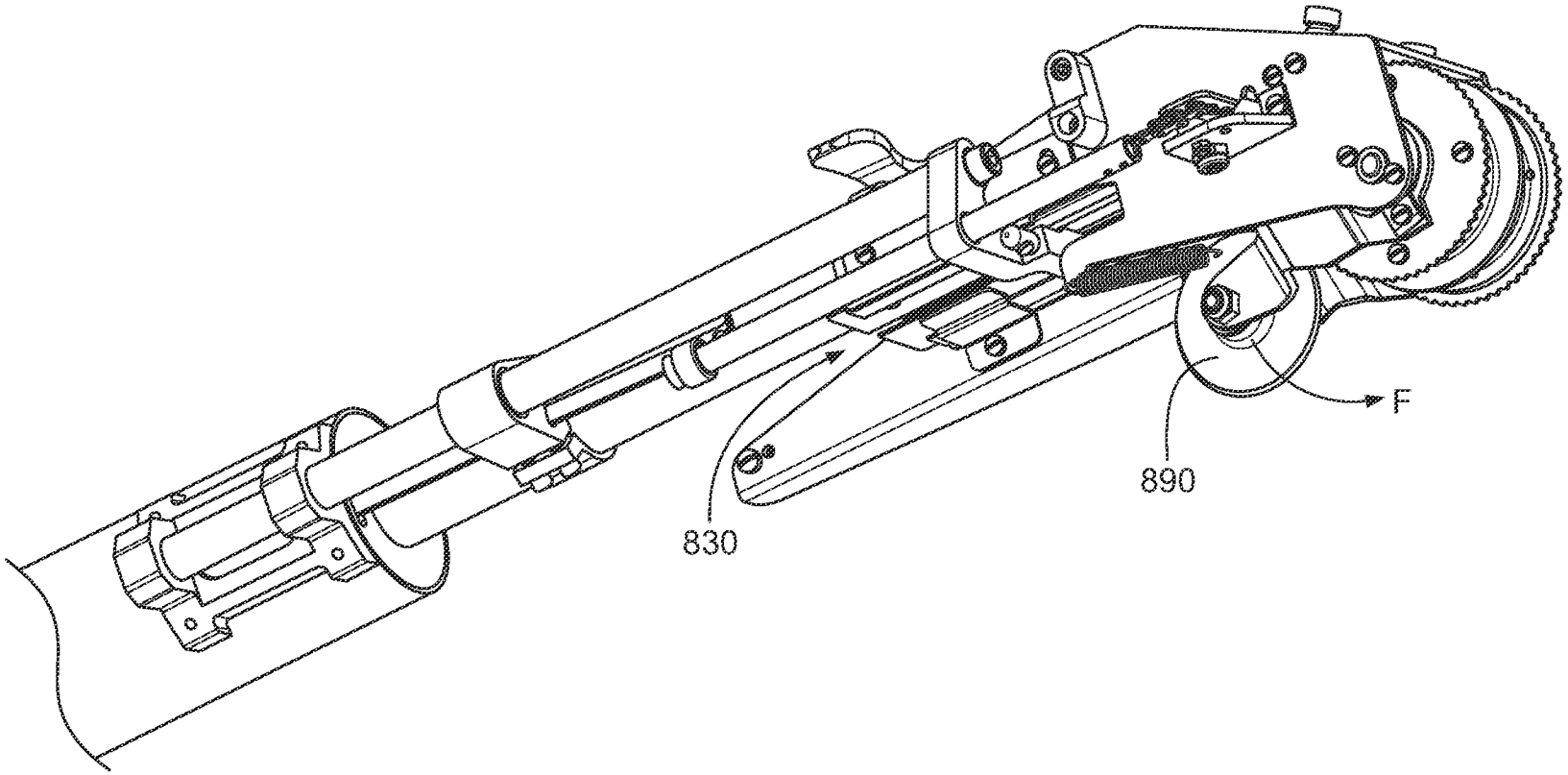

FIG. 33 is a close-up view of the head end of the taping tool in the embodiment in FIG. 29.

DETAILED DESCRIPTION

Figure 4:
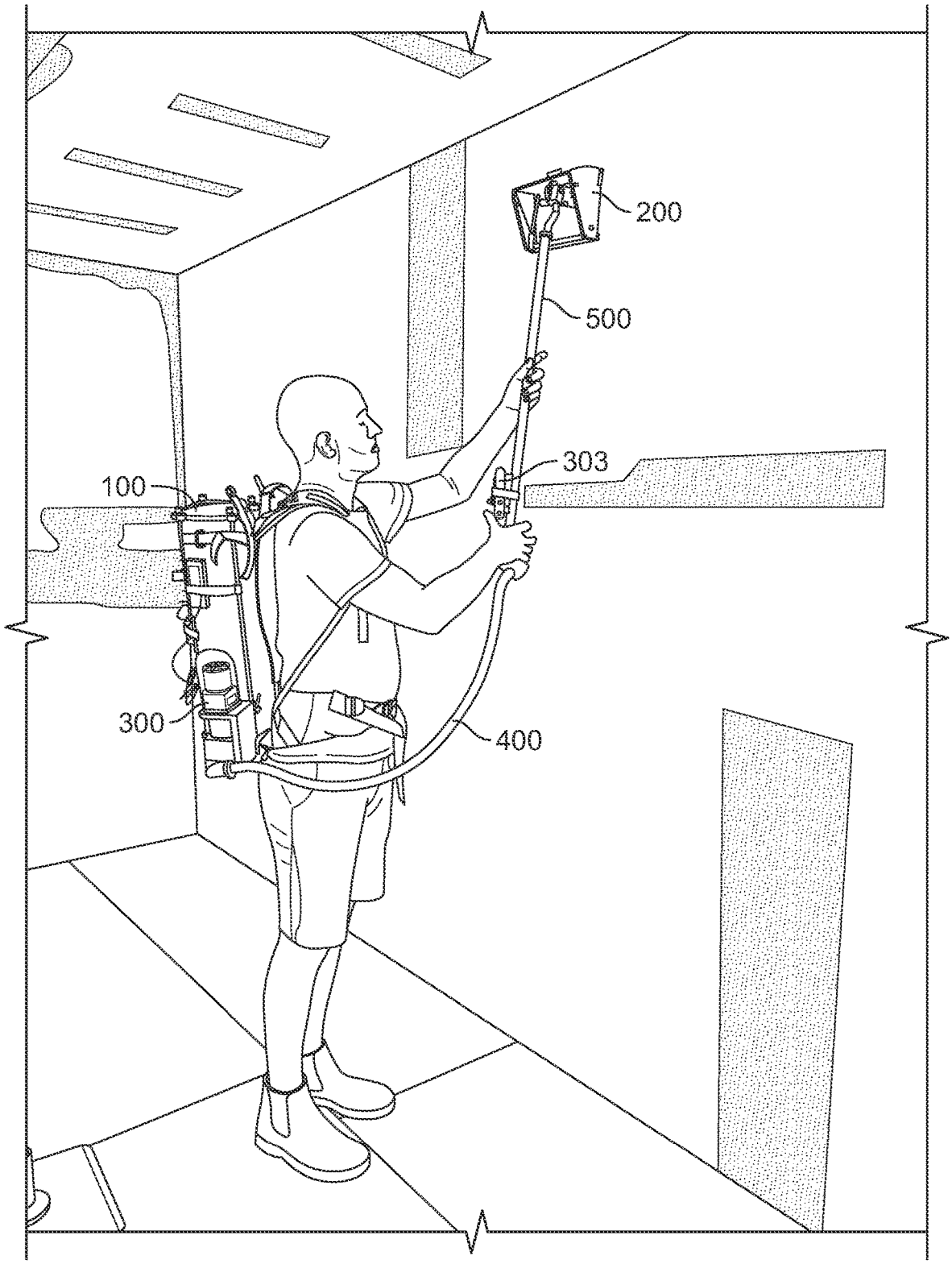
FIG. 4 shows a wearable apparatus for use in drywall plastering for applying a pumpable drywall finishing compound in accordance with one embodiment of the present invention when being worn and used by a user.

As mentioned above, FIGS. 4 and 5 (and others) show a wearable apparatus 10 for use in drywall plastering for applying a pumpable drywall finishing compound (also sometimes known as joint compound) in accordance with one embodiment of the invention. FIG. 4 shows the apparatus 10 when it is being worn and used by a user. The apparatus 10 itself is shown in greater detail in subsequent figures.

Figure 5:
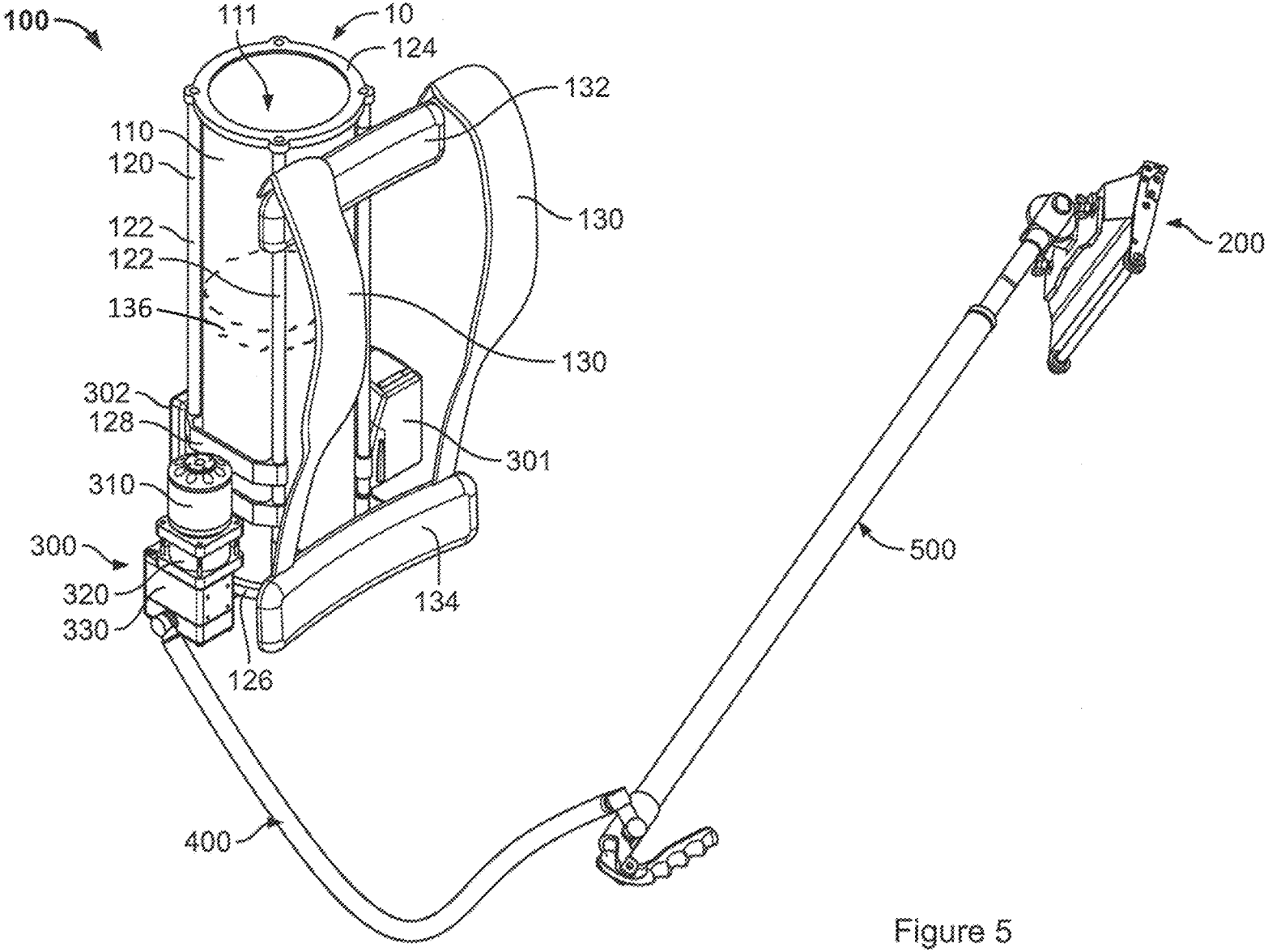
FIG. 5 is a first view of the wearable apparatus in FIG. 4 (i.e. this Figure shows the apparatus but not the user) from above and in front of the apparatus' tank and harness/straps.
Figure 6:
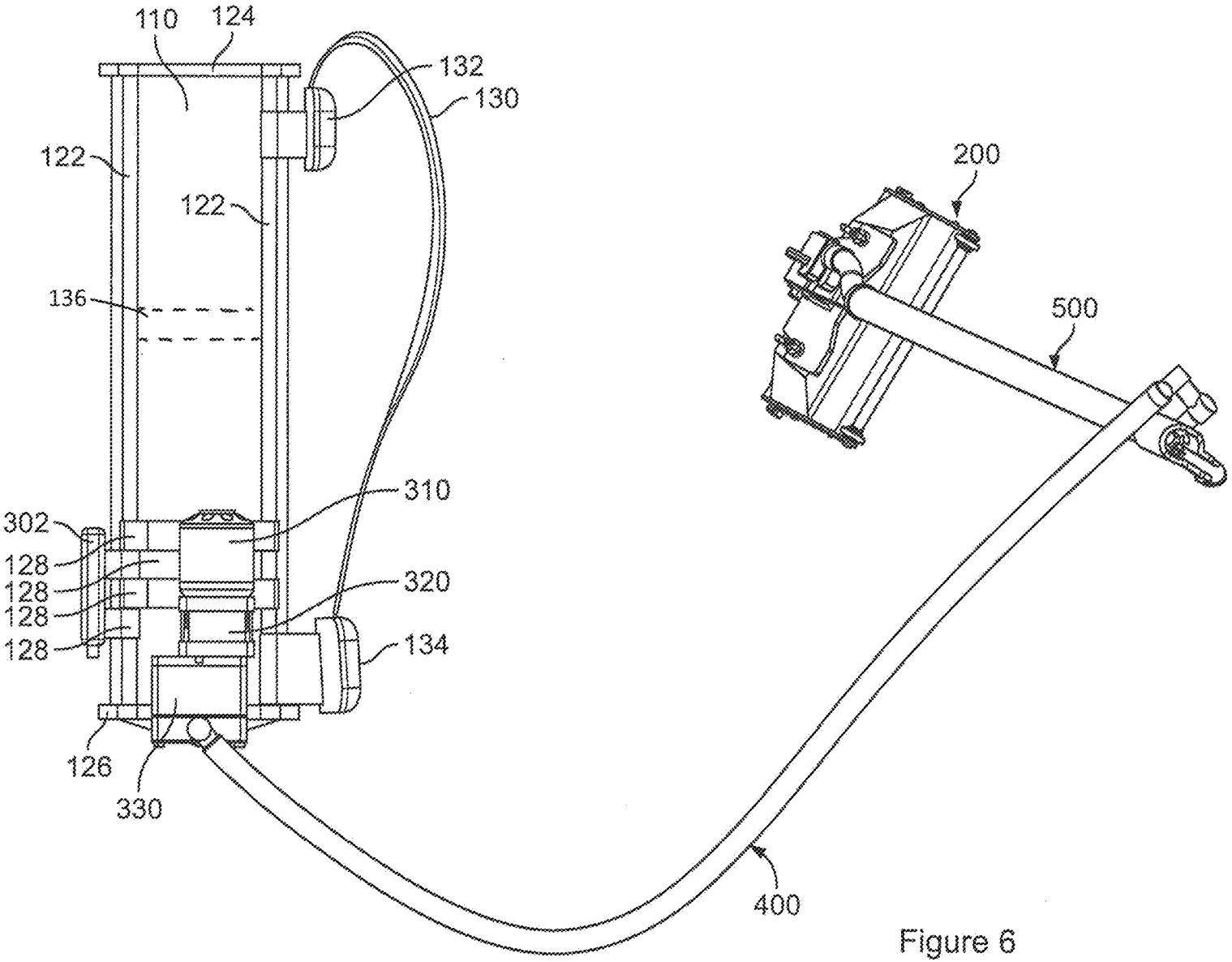
FIG. 6 is a second view of the apparatus from one side of the apparatus' tank and harness/straps.
Figure 7:
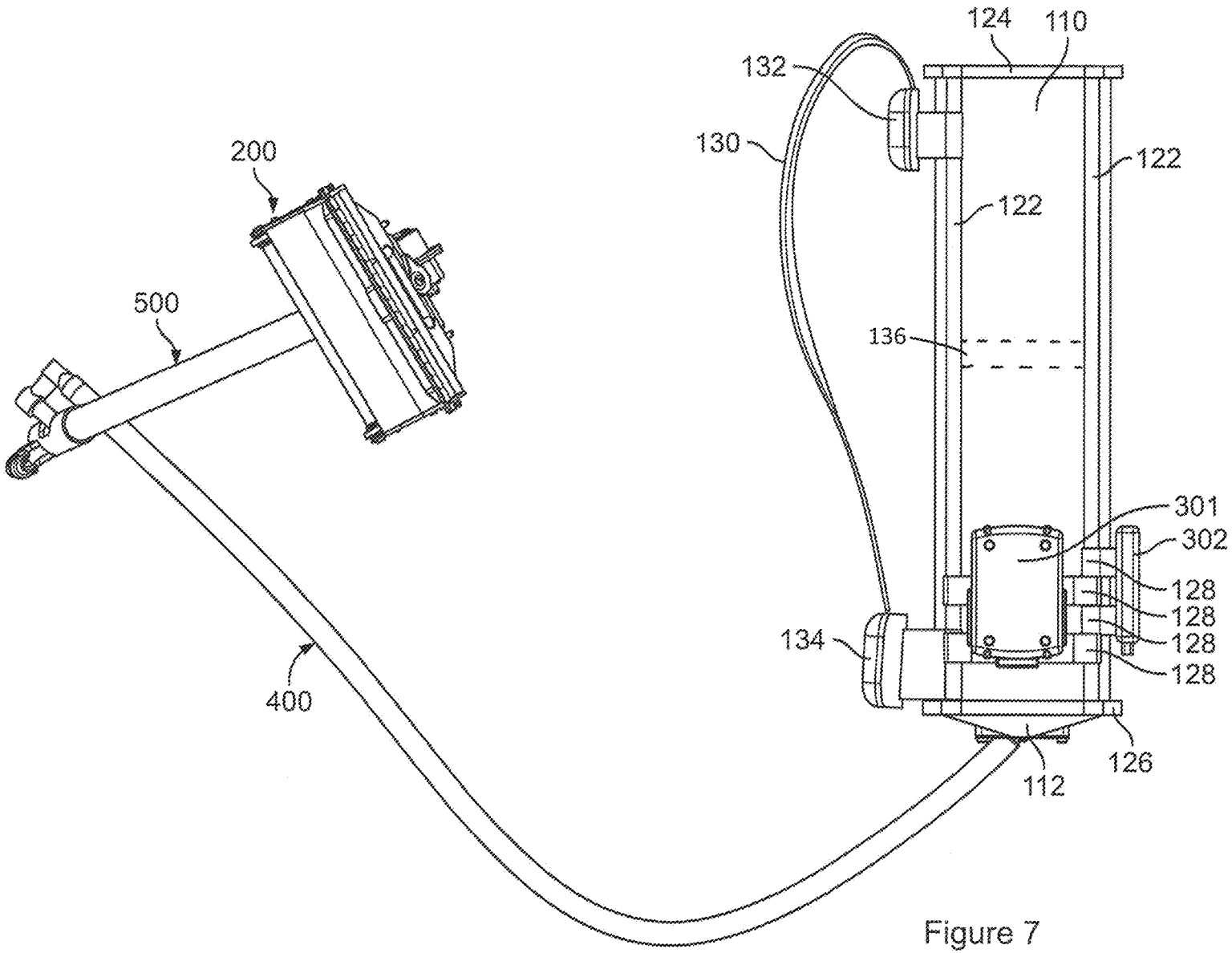
FIG. 7 is a third view of the apparatus from the other side of the apparatus' tank and harness/straps.

As shown in FIG. 5 (and also in later figures), the apparatus 10 includes:

- a tank assembly 100 including a receptacle in the form of a cylindrical tank 110 which contains the finishing compound;
- an applicator in the form of a tool 200 for applying the compound to the surface—in the particular embodiment shown in FIG. 4 (and other figures) the tool 200 is a flat applicator tool (i.e. it is a tool for applying the compound to a flat surface), although a range of other tools may also be used instead of the particular flat applicator tool 200 shown, for example, the tool could instead be a tool configured for applying compound to a corner, such as a concave (or internal) e.g. 90° or other concave corner, or a convex (or external) e.g. 270° or other convex corner;
- a motor and pump assembly 300, which includes (among other things) a pump 330 (in this embodiment the pump 330 is a form of lobe pump) for pumping the compound from the tank 110 to the tool 200 for application to the surface; and
- a conduit, which in this embodiment takes the form of a flexible hose 400, through which compound is pumped from the tank 110 and ultimately to the tool 200 for application to the surface.

It can also be clearly seen from FIG. 4 that the apparatus 10 in this embodiment includes an arrangement of shoulder straps, and also shoulder and lumber pads and a waist strap, which together form a backpack-style harness attached to the tank 110 (or more specifically, these straps and pads attach to the tanks' supporting frame), such that the tank 110, and also the pump 330, and the associated components of e.g. the motor and pump assembly 300 that are attached to the tank 110, and the battery pack 301 that contains the battery, etc, can be worn by the user like a backpack.

The hose 400 which carries the compound from the pump 330 to the elongate handle 500, through which the compound is then conveyed to the tool 200, also attaches to and extends directly from the pump 330, such that the user is able to hold the handle 500 by hand, and thereby control and use the apparatus 10 to apply compound which is pumped from the tank 110 and ultimately to tool 200 for application to the surface, all while wearing the tank 110 etc as a backpack.

The apparatus 10 in this embodiment has a number of advantages over the prior art discussed in the Background section above. For example, the tank 110, given its size, is able to hold a far greater amount of finishing compound compared to the "batch fill" tools discussed in the Background section above in which the tool's receptacle for containing the compound is inside the tool itself (i.e. inside the part of the tool which is pressed against the surface when the tool is in use and therefore necessarily small). Technically, the apparatus 10 is similar to the "batch fill" tools discussed in the Background section above insofar as the tank 110 of the apparatus 10 still has a finite capacity, and therefore the user must still return to refill the tank 110 once all of the compound contained in the tank 110 has been used. Accordingly, the apparatus 10 in this embodiment might perhaps still be described as a form of "batch fill" tool, although given the size and volume of the tank 110 (which is much larger than the size of the small receptacle in the "batch fill" tools discussed in the Background section above) the apparatus 10 operates with much larger "batches" of compound.

Because the volume of the tank 110, and hence the amount of compound that the user is able to transport around with them as they work using the apparatus 10, is far greater than with the "batch fill" tools described in the Background section above, it follows that the amount of time that is wasted by the user having to repeatedly return to refill/reload is significantly reduced with the apparatus 10.

The way in which the apparatus 10 in this embodiment is configured to enable the tank 110 etc to be carried effectively like a backpack also means that the (comparatively much greater) weight of the compound therein is supported by the user's larger trunk and leg muscles. Thus, most of the weight of the apparatus 10 is therefore not required to be held up (or held out at a distance) by the user's arms and shoulders. In fact, the weight of all of the compound in the tank 110 (along with the weight of the tank 110 itself, its frame and also the other parts and components which form part of the "backpack" portion of the apparatus 10) is supported on the user's shoulders and lower back and worn on the user's back. Consequently, the only weight which the user must bear with their arms is the weight of the tool 200, the handle 500, the hose 400, and the weight of the comparatively small quantity of compound that is contained within the hose 400, handle 500 and tool 200 from time to time. In any case, even when the combined weight of the tool 200, handle 500, hose 400, and the compound contained within them from time to time, are combined, the amount of weight which the user is required to bear with their arms is still much less than the weight which a user would have to bear with their arms when using one of the previous "batch fill" tools described in the Background section above.

The apparatus 10 also has a number of advantages over the continuous flow system and other powered/pressurised systems described in the Background section above. For example, the apparatus 10 is completely self-contained, including in that (as described further below) the pump 330 which pumps the compound from the tank 110 to the tool 200 is powered by an electric motor, which is in turn powered by a battery, and the pump, motor and battery are all also mounted (together with the tank 110) on the "backpack" portion of the apparatus. Thus, the apparatus 10 is self-contained and self-powered, and it is consequently able to operate completely "untethered". That is, the apparatus 10 does not require any power cables extending from the apparatus to a remote power outlet or generator, and there is also no need for any hoses or the like to deliver finishing compound or compressed air or anything like that to the apparatus 10 while it is in use. Consequently, many of the problems with the continuous flow system and other powered/pressurised systems described in the Background section above, many of which were related to the fact that those systems require power cables to supply mains power, or hoses to deliver finishing compound or compressed air from some remote location, and including the fact that that aspect of the design of those systems leads to trip hazards and it can also restrict or limit the way in which the device can be used, or limit how far the user can move when using the device, etc, simply do not apply to the apparatus 10.

The battery which powers the electric motor on the apparatus 10, which in turn drives the pump 330, is contained within a battery pack 301 which is mounted on the opposite side of the tank from the pump 330, as shown in later figures. Any form of battery capable of storing sufficient energy and supplying power at a voltage and current required by the electric motor to drive the pump may be used. It is envisaged that rechargeable batteries may often be used, but the invention could also operate using replaceable batteries. There is no trip hazard posed by the apparatus 10 because, as shown in FIG. 4, the hose 400 of the apparatus 10 is only as long as is necessary to enable the handle 500 (with the tool 200 mounted thereon) to be held and moved within the range that the user's arms are capable of. In other words, the hose 400 of the apparatus 10 does not need to be long enough for the handle 500 to move to any positions that are further from the backpack than the user could reach with his/her arms while wearing the backpack portion of the apparatus. The hose 400 of the apparatus 10 will therefore never be long enough to coil up or snake along the floor to create a trip hazard while the apparatus 10 is in use.

Furthermore, because the user is able to wear the tank 110 (and the other parts of the apparatus 10 mounted thereto) like a backpack, and to also use the tool 200 to apply finishing compound to surfaces while doing so, the numerous difficulties associated with the heavy and cumbersome powered continuous flow system described in the Background section above, for example in terms of difficulties moving the large hopper and pump from one location to another, or from one floor to another, etc, do not apply to the apparatus 10. Indeed, there are virtually no mobility limitations with the apparatus 10 because it is worn by the user and is therefore able to be taken anywhere the user is able to walk whilst wearing it. This includes being able to move from one location to another, or from one floor to another, easily. And, as explained above, because of the comparatively much larger capacity of the tank 110, the frequency with which the user must return to refill the tank 110 after all of the compound therein has run out will be much less than with the previous forms of "batch fill" tools described in the Background section above.

The apparatus 10 will now be described in greater detail with reference to FIG. 5 and subsequent Figures.

As shown in FIG. 5 (and also in a number of other Figures) the tank 110 is in the shape of an elongate circular (hollow) cylinder, and the tank is mounted to the harness (the harness includes shoulder straps 130, pads 132, 134, etc) such that the tank 110 is oriented vertically (i.e. with its principal longitudinal axis extending vertically) when the "backpack" portion of the apparatus 10 is worn by the user.

The circular upper end 111 of the tank 110 is open, and there is a movable piston 136 inside the tank 110. The piston 136 (indicated in dashed lines in FIGS. 5, 6, 7 and 8) can be withdrawn out through the open top end 111 of the tank 110 in order to allow the tank 110 to be refilled with compound by pouring or pumping the compound into the tank 110 through the open upper end 111. After the compound has been poured, pumped or otherwise inserted into the tank 110 through the open top end 111 to fill it (or at least to fill the tank up as much as required for a particular intended use), the piston 136 can then be inserted back through the open top end 111 of the tank and forced downwards inside the tank until it contacts and presses vertically downwards on the compound within the tank.

One means for filling (or refilling) the tank 110 with finishing compound (or for inserting finishing compound into the tank 110 to the level (or in the amount) required on a given occasion) is described in the previous paragraph. In addition to that, it is also possible with the apparatus 10 in the particular embodiment shown (and possibly also in other similar embodiments) that the tank 110 may be able to be refilled in another way as well. This alternative way of refilling the tank 110 involves (if necessary, first removing the tool 200 from where it is mounted on the end of the handle 500, and then) placing the end of the handle 500 into a bucket or vat (or other vessel) containing the ready-mixed finishing compound which is to be loaded into the tank 110. Next, with the distal end of the handle 500 inserted into the compound such that the opening in the end of the handle 500 is submerged in (or at least in contact with) the compound, the tank 110 can then be refilled by operating the pump 330 in reverse in order to "suck" the compound back up through the handle 500, back through the hose 400 and pump 330, and into the tank 110 through the opening in the tank's base (this opening in the base of the tank 110 is described further below).

In any event, when there is compound contained within the tank 110 and the apparatus 10 is in use, the piston 136 presses down from above on the top of the compound which is contained beneath the piston 136 within the tank. The piston 136 itself is actually urged downwards against the compound beneath it, and the piston 136 moves down and continues to press down on the compound as the level of compound in the tank drops as the apparatus is used, due to the force of gravity and also due to atmospheric pressure which presses down on the piston 136 from above.

When the apparatus 10 is in use, and the compound is pumped (by the pump 330) out through an opening 113 which is located in the otherwise closed lower end 112 of the tank 110 (see FIG. 9 and note that the compound exiting the opening 113 in the base of the tank next passes directly into the pump 330), the level of the compound within the tank 110 will naturally drop, and as it does so (as mentioned above) the piston 136 moves downwards and continues to press down on the compound from above. The side of the piston 136 also seals against the internal wall of the tank 110, and as a consequence, the piston 136 cleans any compound off the internal wall of the tank as it moves down, and the piston 136 also helps to protect the compound in the tank from exposure to outside air. In doing so (e.g. in pushing down on the compound from above, and cleaning any compound off the internal wall of the tank as it moves down such that no compound remains on or dries on the internal wall, and also in providing a seal against the outside air), the piston 136 helps to ensure that as much of the compound as possible is available to be pumped and used, and it also helps to prevent air pockets within the compound pumped to the tool.

Turning again to FIG. 5, it can be seen that the tank 110 is supported by a frame 120, which includes (in this embodiment) four elongate rods 122, an upper circular clamping member 124 and a lower circular clamping member 126. The upper circular clamping member 124 extends around the circular rim on the upper end 111 of the tank 110. Similarly, the lower circular clamping member 126 extends around the circular perimeter at the base 112 of the tank 110. The four elongate rods 122 are at equally spaced locations around the circumference of the cylindrical tank 110, and each rod 122 extends along the length of the tank from the upper clamping member 124 to the lower clamping member 126. Thus, the tank 110 is supported between the upper clamping member 124 (at the top) and the lower clamping member 126 (at the bottom) and it is held horizontally between (and within) the rods 122. There are also a number of bracing members 128 which help to support and provide additional rigidity to the rods 122. The bracing members 128, which are located toward the lower end of the tank, also help to facilitate the mounting of other components (like e.g. the battery housing 301 and the electronics housing 302) to the frame 120.

FIG. 5 shows that there is also a pair of shoulder straps 130 which are worn over the user's shoulders in order for the tank (and the other associated components) to be worn as a backpack. In FIG. 4, the harness of the apparatus' "backpack" portion is also shown as including a waist strap that extends around the user's waist, and such a waist strap may indeed be used, although the waist strap is not shown in any of the other Figures. The shoulder straps 130 do not attach directly to the frame 120. Rather, there is a pair of pads, namely an upper shoulder pad 132 which attaches directly to an upper part of the frame 120, and a lower lumbar pad which attaches directly to a lower part of the frame 120, and the upper end of each shoulder strap 130 attaches to the shoulder pad 132 and the lower end of each shoulder strap 130 attaches to the lower lumbar pad 134. Although not shown in most of the Figures (except FIG. 4), the shoulder straps 130 (and any other straps) may be made adjustable in any conventional manner by which this is done on backpack straps and the like. All straps are also padded in a similar manner to the straps used on hiking backpacks, rucksacks and the like, so as to provide comfort for the user during use (especially prolonged use) of the apparatus 10. Padding is also provided on the shoulder pad 132, which contacts with the user's back between the tops of the shoulder straps 130, and also on the lumbar pad 134 which contacts the user's lower back.

FIG. 5 also shows that the apparatus 10 includes a motor and pump assembly 300. The motor and pump assembly 300 includes:

- a battery housing 301 (this houses the battery that is used to power the electric motor 310);
- an electronics housing 302 (this houses the circuitry and electronics associated with the electric motor and its controls);
- an electric motor 310—in this embodiment the electric motor is a brushless DC motor of the kind described below;
- a gearbox 320; and
- a pump 330.

As shown in the Figures, the electric motor 310, gearbox 320 and pump 330 are all mounted near the base of the tank on the right-hand side. (The right-hand side is the side of the tank that would be on the user's right-hand side when the tank is being worn on the user's back.) However, the battery housing 301 is mounted near the base of the tank on the left-hand side, and the electronics housing 302 is mounted at the back of the tank.

The only Figure which shows the controls 303 used for controlling the electric motor 310 (bearing in mind that it is the electric motor 310 that drives the pump and thereby operates to start and stop the flow of finishing compound etc) is FIG. 4. In FIG. 4, the controls 303 for operating the electric motor 310, i.e. for turning it on and off, and adjusting its speed (and direction), to thereby start, stop and adjust the flow rate (and flow direction, i.e. pumping or sucking) of the compound, is shown mounted on the handle 500 toward the lower end thereof. In this position, as FIG. 4 shows, the controls 303 are able to be operated by the user's thumb on one hand whilst also allowing the user to operate the apparatus' brake mechanism with the fingers of the same hand (as discussed further below).

The way in which the controls on the handle 500 connect to the electronics and circuitry contained within the electronics housing 302, and likewise the way in which the electronics and circuitry contained within the electronics housing 302 connect to the electric motor 310, is generally conventional (i.e. by connecting wires, etc, not shown, or in the case of the particular controls 303 shown in FIG. 4 these are actually configured to communicate wirelessly with the electronics within the housing 302), and in any case this is not a crucial aspect of the invention and therefore it need not be explained further. The details of the electronics and circuitry contained within the electronics housing 302 are also not critical to the invention and therefore will not be explained in further detail either.

Figure 10:
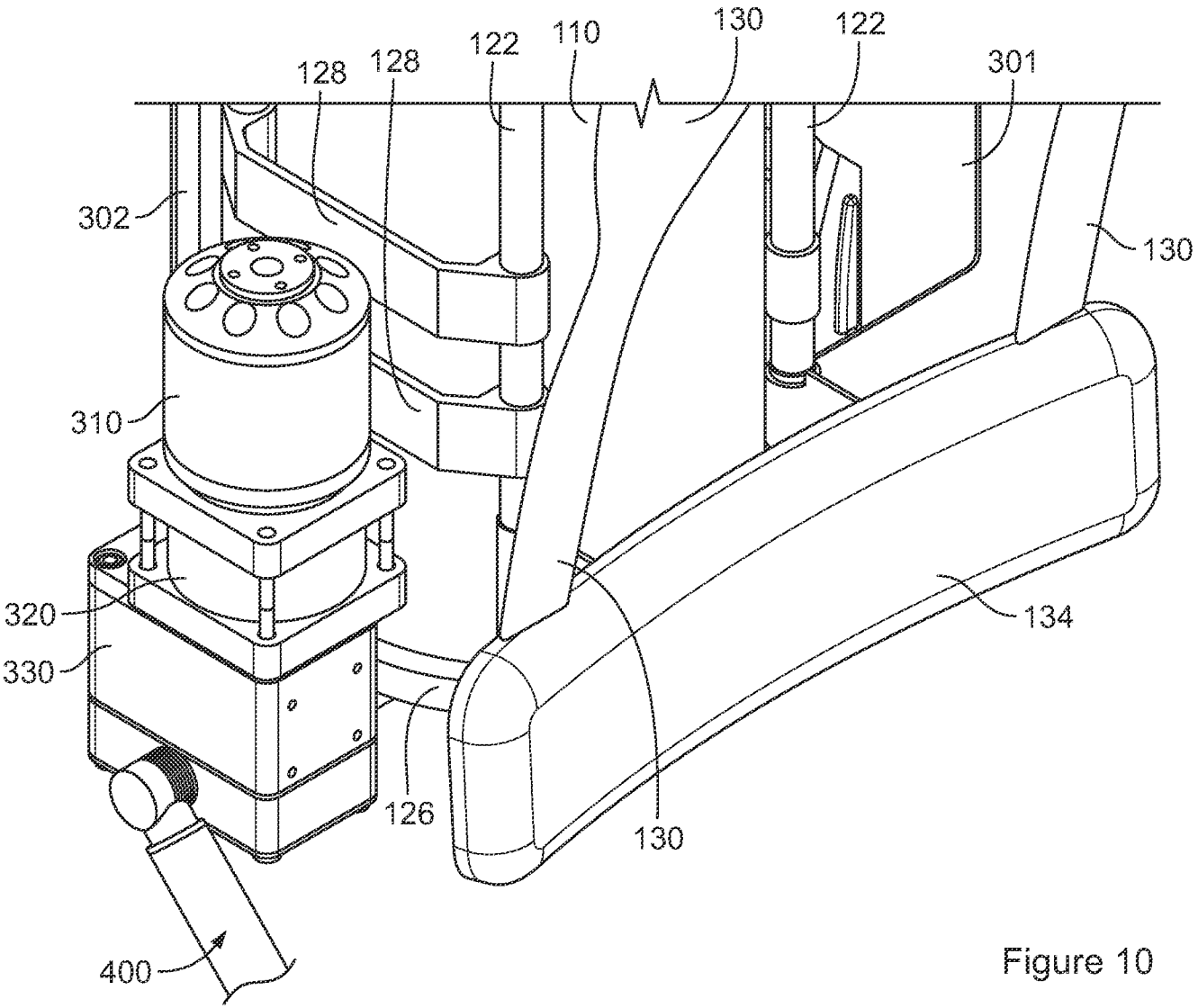
FIG. 10 is a close-up view of the lower portion of the apparatus' tank etc, and also showing the apparatus' motor, gearbox and pump.

FIG. 10 is a close-up view of the lower part of the "backpack" portion of the apparatus in FIG. 5. FIG. 10 therefore shows, in particular, the motor and pump assembly 300, which is made up of the electric motor 310, the gearbox 320 and the pump 330, and FIG. 10 shows the way in which these three parts of the motor and pump assembly 300 are arranged relative to one another, and their location. As shown, the electric motor 310 is mounted on top of the gearbox 320, which is in turn mounted on top of the pump 330, and together these three components are mounted on the right-hand side near the base of the tank 110. The way in which the motor and pump assembly 300 is mounted to the rest of the apparatus is that the pump 330 is fixedly attached on (and in fluid communication with) the end of the outlet pipe/conduit that leads from the opening 113 in the base 112 of the tank 110. The gearbox 320 is mounted directly on top of the pump 330, and the electric motor 310 is mounted directly on pop of the gearbox 320. The operation of these components is described below.

The electric motor 310 in this embodiment is a brushless DC motor. Modern brushless DC motors are able to provide a relatively high amount of power given their relatively small size and weight. In other words, modern brushless DC motors can often have a high power to weight ratio. The use of an electric motor with a high power output, and low weight, is quite important in this invention because, on the one hand, it is important to minimise weight (in order to minimise user fatigue etc), and helping to minimise the weight of the electric motor contributes to minimising the overall weight of the apparatus. At the same time, the compound which is required to be pumped from the tank 110 and ultimately to the tool 200 for application to the surface is, by its nature, a heavy and highly viscous paste, and therefore the pump used to pump this viscous paste needs to be driven by quite a powerful motor in order for the apparatus to function as required (i.e. in order for the compound to be pumped in the volume, and at the rate, necessary for it to be applied in the required quantity and at the desired speed to the surface). A range of brushless DC motors suitable for use in the present invention are commercially available, and there is no strict limitation on what kind (or type or size or power capacity, etc) of motor should be used. It has been found that the kind of electric motors that are often used nowadays to drive electric skateboards are suitable because of their low weight, high power output, and also compact size, which makes them easy and convenient to mount on the "backpack" portion of the apparatus. Motors such as those used for electric skateboards (and in other similar applications) nowadays are also suitable because the power is generally provided at relatively low rpm but with high torque, which is also preferable for driving the pump in the present application (without requiring too much reduction by the gearbox, because the greater the amount of reduction that the gearbox is required to provide, the larger and heavier the gearbox is likely to be) because the pump for pumping the heavy and viscous compound must also generally operate at low speed but with high torque.

One example motor that is thought to be suitable is the Maytech MTO6355-230 KV-HA, which can be purchased at https://maytech.cn/.

Although brushless DC electric motors, and in particular the types commonly used on electric skateboards and the like (as discussed above), are thought to be suitable, as also mentioned above it must be understood that there is no particular limitation on the kind of motor that may be used in the present invention. Therefore, the invention (e.g. in other embodiments) could potentially operate with other types of electric motors. In fact, the use of an electric motor is not even a requirement, and the invention could potentially be driven in other ways, for example the apparatus' pump could possibly be driven by some other means, like e.g. pneumatically, or it could be powered by a small internal combustion engine that is mounted and worn as part of the "backpack", etc.

As explained above, the gearbox 320 is mounted in between the electric motor 310 and the pump 330. In this particular embodiment, the gearbox 320 is a planetary reduction gearbox, and it functions to reduce the speed, and therefore increase the torque, of the rotation produced by the electric motor before the rotation is transmitted (by the gearbox) to the input shaft of the pump 330 to drive the pump. It will be appreciated that, in some other embodiments (e.g. depending upon the power and torque capabilities of the motor) there may not even be a need for a gearbox (e.g. if an electric motor (or whatever other means for driving the pump is used) is provided which is able to deliver rotation at a speed and torque suitable for driving the pump 330 to pump the compound at the required rate). In the apparatus 10 shown, a gearbox 320 (which is a planetary reduction gearbox) is used; however the design of the particular planetary reduction gearbox 320 used, and the way it operates, is conventional, and as the design of the gearbox and the way operates is not critical to the invention anyway, this need not be discussed further.

As mentioned above, the electric motor 310 operates (when controlled by the user using the controls 303) to generate rotation, and the speed of the rotation is then reduced (and the torque is consequently increased) before the rotation is transferred to the input shaft of the pump 330 to drive a pump.

Unlike the electric motor 310 and the gearbox 320 discussed above, the pump 330 used in the apparatus 10 is not simply one (or a type) which was already in existence and available "off-the-shelf" prior to the present invention. On the contrary, in order to provide the performance characteristics desired for pumping the finishing compound in the present drywall finishing application, and in particular given:

- the high weight and high viscosity of the compound to be pumped,
- the rate at which the compound needs to be pumped (in order for the compound to be applied to the surface in the amount, and at the speed, desired),
- the need for the compound to be pumped smoothly, that is, with minimal variability or irregularity in the flow rate at which the compound is delivered to the tool and hence applied to the surface by the tools, and
- the need to minimise the weight of the pump (in order to minimise the weight of the apparatus overall)

a new pump was developed for use in the presently described embodiment, as no existing form of pump could be found that would achieve the above performance characteristics as well as is often desired.

Figure 8:
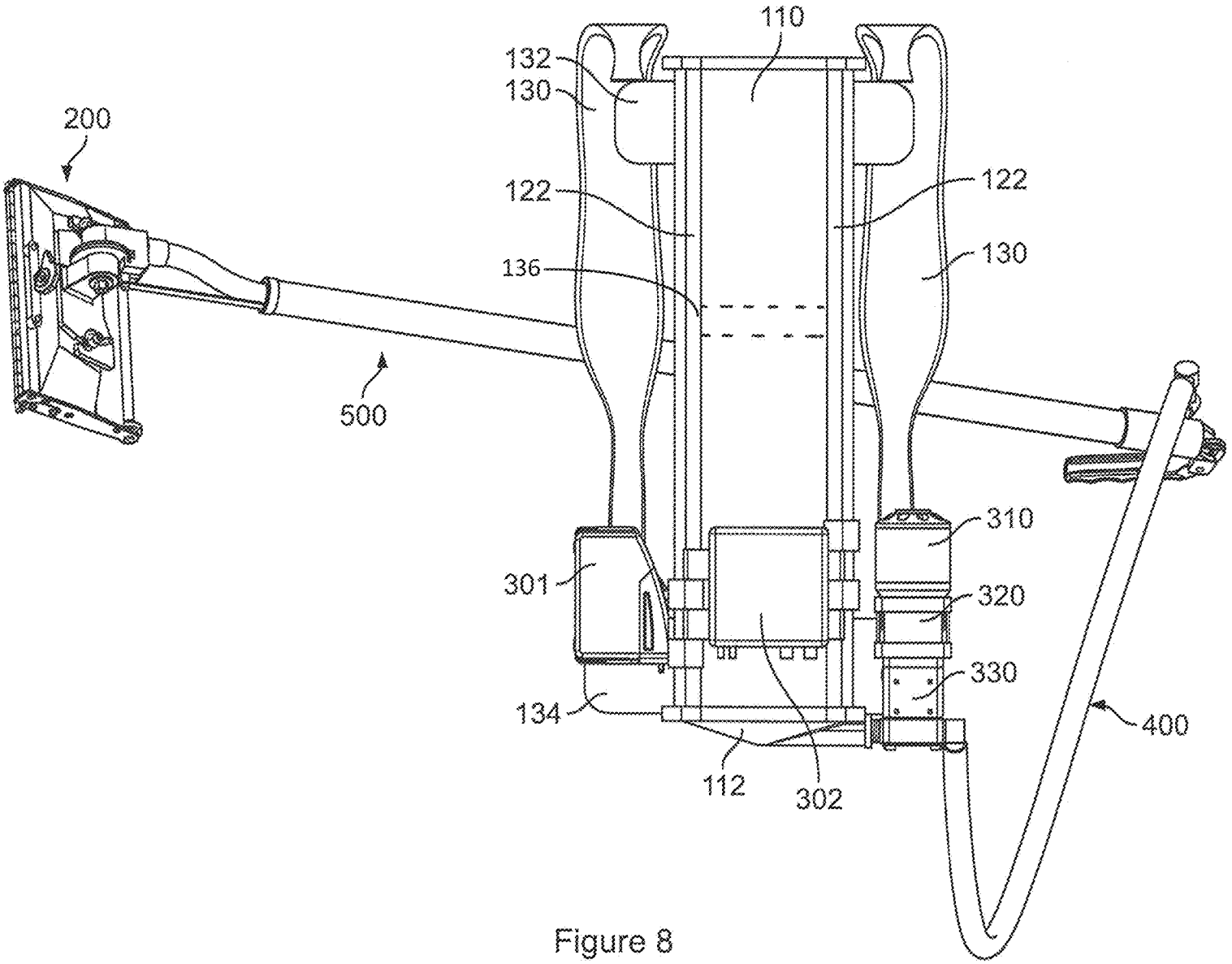
FIG. 8 is a view of the apparatus from the rear (i.e. from behind) the apparatus' tank and harness/straps.
Figure 9:
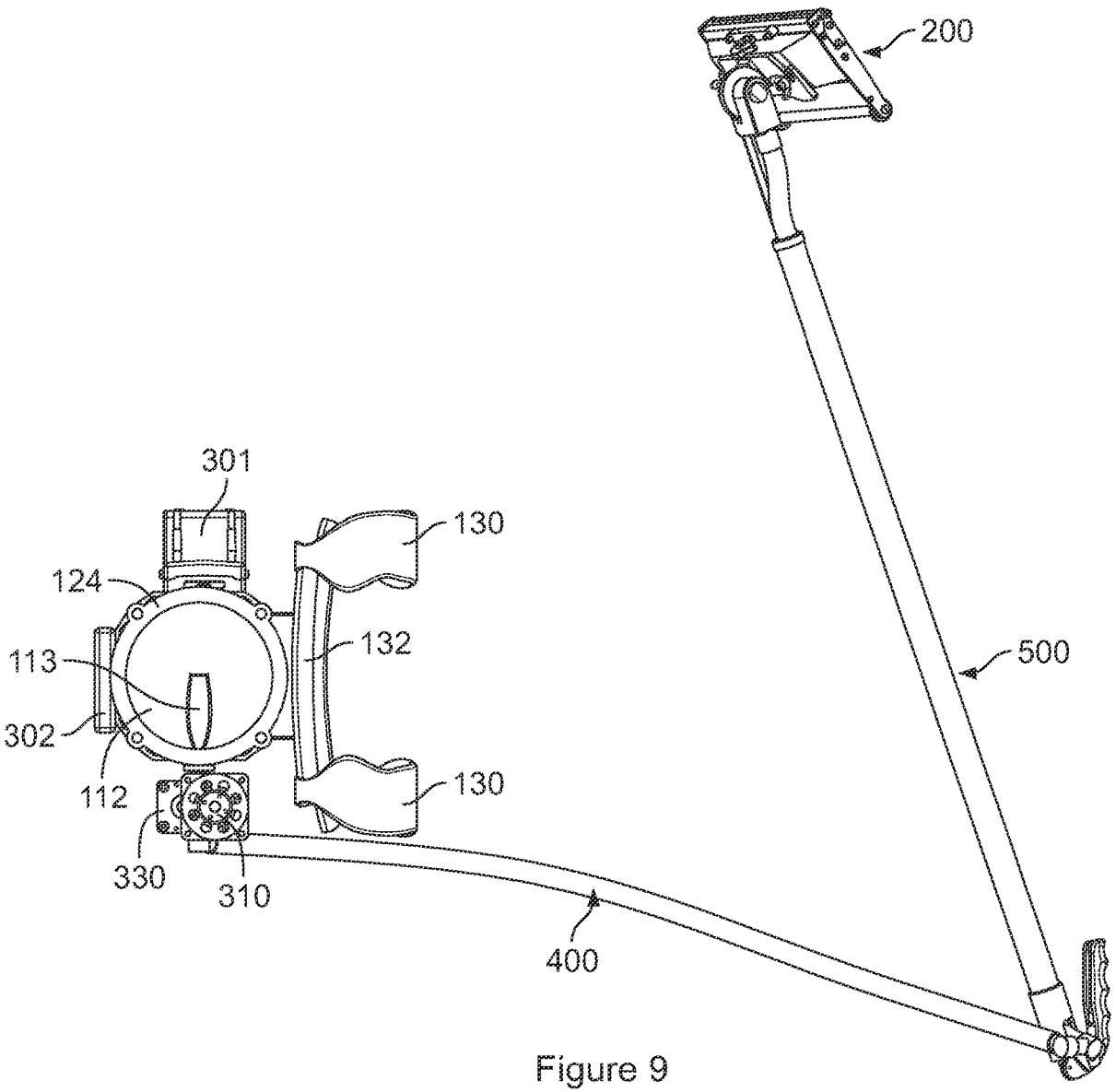
FIG. 9 is a view of the apparatus from above.
Figure 11:
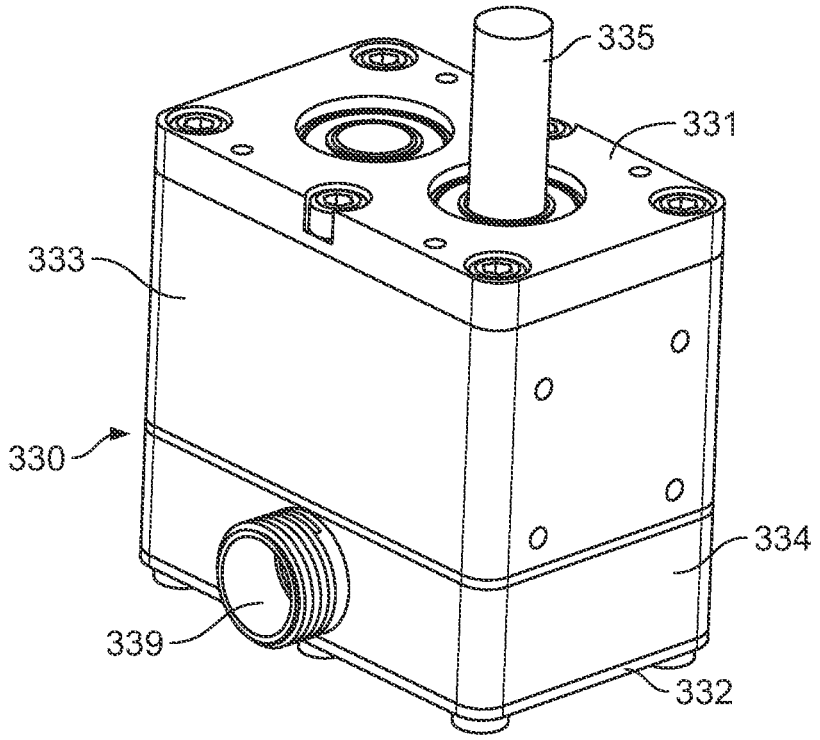
FIG. 11 shows the pump used in the apparatus in FIG. 4 to FIG. 10.
Figure 12:
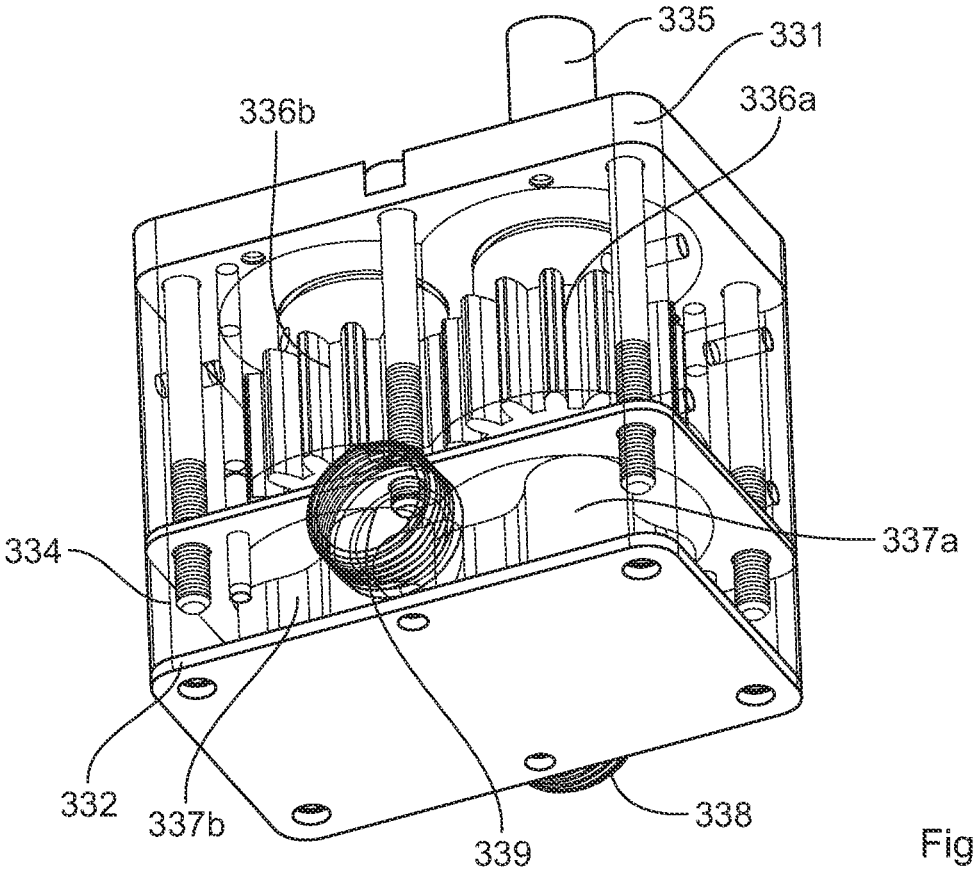
FIG. 12 is another view of the pump, but in this Figure certain parts of the pump's exterior have been made to appear transparent in order for some of the internal parts of the pump to be visible.
Figure 13:
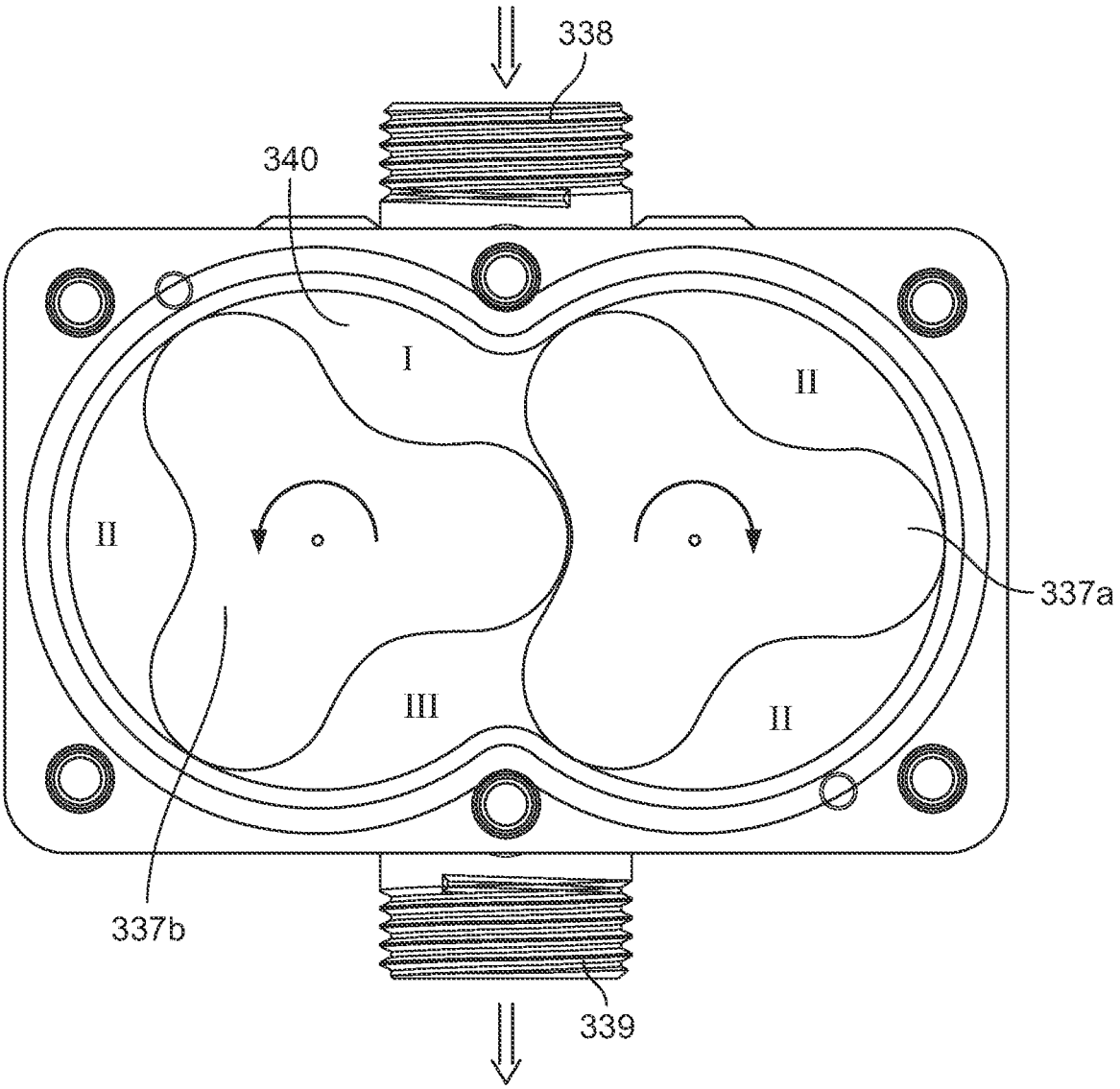
FIG. 13 is yet another view of the pump, but in this Figure the pump is viewed as if from underneath (i.e. as if looking up from underneath in the orientation in which the pump is shown in FIG. 11 and FIG. 12) and in FIG. 13 the bottom plate of the pump is removed to show the lobes of the pump and the cavity within which they rotate.

The particular pump that was developed for use in the apparatus 10 is illustrated in FIG. 11, FIG. 12, and FIG. 13. As shown in these Figures, the pump 330 has an outer body which is made up of:

- a top cover plate 331 (the pump's input shaft or "drive-shaft" 335 extends through an opening in the top cover plate 331),
- a bottom plate 332,
- a gear casing 333 made of aluminium which provides the upper parts of the sidewalls of the pump (and the pump's gears, discussed below, operate within cavities on the inside of the gear casing 333),
- a lobe casing 334 made of stainless steel which is mounted to the bottom of the gear casing 333, and inside the lobe casing 334 there is a separate region (separate from the region inside the gear casing 333) that contains the lobes, which are also discussed below,
- a pair of matching (i.e. equally sized and toothed) spur gears 336, the respective teeth on which mesh with the other—more specifically there is:

a drive gear 336*a* which is mounted on a portion of the driveshaft 335 which is inside the pump, and the drive gear 336*a* therefore rotates with the driveshaft, and an identical driven gear 336*b* which is mounted on separate shaft (the driven shaft) which is parallel to the driveshaft 335 and on the inside of the pump, such that the driven gear 336*b* meshes with the drive gear 336*a* so that rotation of the drive gear 336*a* (which is at the speed and in the direction of the driveshaft 335) causes rotation of the driven gear 336*b* (and the driven shaft) at the same speed but in the opposite direction, a drive lobe 337*a*, which (as best shown in FIG. 13) is a tri lobe mounted on the lower end of the driveshaft 335 such that the drive lobe 337*a* rotates with the driveshaft 335, and the drive lobe 337*a* is located within a "FIG. 8" shaped pumping chamber 340 on the inside of the pump, between the dividing wall 334 and the base plate 332, a driven lobe 337*b*, which (as best shown in FIG. 13) is also a tri lobe mounted on the lower end of the driven shaft such that the driven lobe 337*b* rotates with the driven shaft (driven by the driven gear 336*b*), and the driven lobe 337*b* is also located within the FIG. 8 shaped chamber 340 inside the pump between the dividing wall 334 and the base plate 332, an inlet port 338 through which compound flows into the pump 330 (and in particular into the pumping chamber 340) from the tank 110, and an outlet port 339 through which compound is pumped out of the pump (and more specifically out of the pumping chamber 340 by operation of the lobes—see below) and into the hose 400.

Importantly, the pump 330 in the depicted embodiment, with its drive lobe 337*a* and driven lobe 337*b*, is consequently a form of "lobe pump". Lobe pumps which operate with similarly shaped tri lobes are also used in other applications and industries. However, for reasons discussed further below, lobe pumps having similar shaped tri lobes to those shown in the present Figures, but which are used in other applications and industries, are typically very large and heavy units, often weighing more than 30 kg (and sometimes much more). Accordingly, such conventional lobe pumps used in other applications and industries are unsuitable for use in the present application/apparatus due to their size and weight.

As explained in the Background section above, pumps are sometimes currently used in the plasterboard/drywall finishing industry for pumping finishing compound. For example, pumps are sometimes used to pump the compound from a large receptacle into a bucket so that a tradesman can fill a bucket with compound and take it with him, rather than having to return all the way to the large/main receptacle every time the finishing tool being used runs out. Also, a pump is used in the powered continuous flow system described in the Background section above.

Piston pumps are the kind of pump most commonly used for pumping finishing compound. However, because of the way piston pumps operate using a reciprocating piston, the flow caused by piston pumps can sometimes be irregular. This kind of irregular flow may not be ideal in the present application because, if the finishing compound is pumped to the finishing tool with a flow (or at a rate) that is too inconsistent or irregular, this may make it difficult for a user to use the tool in the present embodiment to apply a smooth, even layer of finishing compound and thereby achieve the desired smooth finish. Basically, a pump which provides an inconsistent or irregular flow may not (it is thought) be ideal as it may prevent the apparatus (like e.g. the apparatus in the present embodiment) from being used (or at least it may make it harder) to achieve a finish of the required standard. Also, the physical size and weight of the kinds of conventional piston pumps used in this industry makes those kinds of pumps unsuitable for use in the present apparatus in which the pump must be carried by the user (on the user's back in this particular embodiment).

Gear pumps are another kind of pump; however these rely upon the gears themselves to both transmit the power and also perform the pump's pumping action. Due to the high viscosity and also the abrasive nature of the finishing compound used in the present drywall plastering finishing application, it is thought that gear pumps may not be suitable (or at least not best suited or ideal).

Flexible impeller pumps are yet another type of pump. Flexible impeller pumps used in other applications and industries are often comparatively light and small, at least compared to the other kinds of existing pumps just described. However, when operated under high load, the impeller in such pumps often becomes deformed, which can in turn reduce the rate of flow from the pump.

In comparison to the above, lobe pumps (because of the way in which the lobes operate to generate flow) are a form of pump which is thought to be able to deliver a more consistent and regular flow, as is thought to be desirable in the present drywall finishing application for the reasons discussed above. However, as also discussed above, the kinds of lobe pumps used in other applications and industries are typically very large and heavy, often having a weight of 30 kg or much more. This would preclude the use of such existing lobe pumps in the present apparatus.

Accordingly, the particular pump 330 used in the present embodiment is a new design of lobe pump in which, although the fundamental/underlying mode of operation (i.e. the way in which the lobes operate to drive the flow through the pump) is similar to other lobe pumps, the pump itself has been redesigned to have a size and weight which is far smaller than other existing lobe pumps in order to make it suitable for use in the present application (as part of an apparatus carried by the user like a backpack).

At this point it is important to note that, even though a number of disadvantages associated with other types and configurations of pump are described above, and even though the particular embodiment shown in the Figures utilises a newly designed pump which is a form of lobe pump (albeit a much smaller and lighter kind of lobe pump than the other forms of lobe pump that have previously been used), nevertheless it is to be clearly understood that there is no strict requirement that the particular lobe pump 330 shown in the Figures (or something like it) must be used in the present invention. In fact, there is no strict limitation as to the kind or type (or even the exact size and weight) of pump that should be used, and therefore it remains possible that any kind of pump (including even the kinds in relation to which certain disadvantages have been discussed above) could be used in the present invention. It is just that, preferably, the pump used (whatever it is) should be comparatively small and lightweight (basically so that the overall weight and bulk of the backpack portion of the apparatus remains manageable) and it should also be able to at least adequately/satisfactorily achieve the performance characteristics discussed above.

Turning to the particular (newly designed) pump 330 shown in the Figures, the exact proportions and dimensions of even this lobe pump are also not critical to the invention, nor are the particular materials used to make the various parts of the pump 330, provided the pump is able to function and adequately/satisfactorily achieve the performance characteristics discussed above. In the particular embodiment shown, many of the parts of the pump 330, such as e.g. the parts that make up the outer body, the shafts, the gears, the lobes and the various fasteners (etc), are made from conventional suitable metal alloys, such as steel, and other components like e.g. bearings, seals, and the like, may also be of conventional materials and design. The general size of the particular pump 330 used in this embodiment is evident from FIG. 4, and hence the relative sizes and proportions of the various parts of the pump will also be evident from the Figures. The particular pump 330 shown in the Figures (which is made from the materials just described) has a weight of approximately 1.3 kg, which it will be noted is a mere fraction of the weight of traditional lobe pumps (which typically weigh in excess of 30 kg).

The design of the lobe pump 330 in the present embodiment, and the ease with which the hose 400 can be disconnected (if necessary), and the ease with which the pump 330 can be disconnected from the tank 110 (if necessary), or the pump 330 can even be disassembled (if necessary), makes it easy to clean. This is desirable because the finishing compound that the pump is used to pump is formulated to (and it is required to) dry/set. It is therefore important to be able to clean all of the compound out of the pump once the apparatus is no longer in use so that finishing compound does not dry/set inside the pump.

The operation of the pump 330 will now be described.

As explained above, the electric motor 310 operates (when controlled by the user using the controls 303) to generate rotation, and the speed of this rotation is then reduced (and the torque is consequently increased) by the gearbox 320. The driveshaft 335 of the pump 330 inserts into the gearbox 320 and is connected with the planetary gear arrangement inside the gearbox. Accordingly, after the rotation generated by the electric motor 310 has been reduced by the planetary gears inside the gearbox 320, the rotation is transmitted into the pump 330 by the driveshaft 335.

As also explained above, the drive gear 336*a* is mounted on a portion of the driveshaft 335 which is inside the pump 330. Accordingly, the drive gear 336*a* rotates with (i.e. in the same direction and at the same speed as) the driveshaft 335. The driven gear 336*b*, which is mounted on the parallel driven shaft inside the pump 330, and which is the same size (and has the same tooth configuration) as the drive gear 336*a*, meshes with the drive gear 336*a*. As a result, when the drive gear 336*a* rotates (on the driveshaft 335), this rotation is transmitted by the meshing of the gears 336*a* and 336*b* to cause the driven gear 336*b* to rotate at the same speed as, but in the opposite direction to, the drive gear 336*a*. Then, because the driven gear 336*b* is mounted on the driven shaft inside the pump 330, the driven shaft is caused to rotate at the same speed as, but in the opposite direction to, the driveshaft 335.

It should next be recalled that:

the drive lobe 337*a* is mounted on the lower end of the driveshaft 335, which means that the drive lobe 337*a* rotates in the same direction and at the same speed as the driveshaft 335;

the driven lobe 337*b* is mounted on the lower end of the driven shaft (i.e. on the same shaft as the driven gear 336*b*), which means that the driven lobe 337*b* rotates in the same direction and at the same speed as driven gear 336*b* (which is the same speed as, but opposite direction to, the driveshaft 335); and the drive lobe 337*a* and the driven lobe 337*b* both reside and rotate within the FIG. 8 shaped pumping cavity 340 within the lower portion of the pump.

Thus, in summary, whenever the pump is driven by the motor, the respective lobes 337*a* and 337*b* rotate at the same speed, but in opposite directions, within the cavity 340, as depicted in FIG. 13.

As the lobes 337*a* and 337*b* turn within the cavity 340 inside the pump (as shown by the rotational direction arrows in FIG. 13), at a certain point in the lobes' rotation the size of the space (I) between the two counter-rotating lobes in the region where the finishing compound enters through inlet port 338 begins to increase, and the size of this space (I) continues to increases as the lobes rotate (in opposite directions). This creates a relative vacuum (or an area of reduced relative pressure) in the region where the finishing compound initially enters the cavity 340 via the inlet port 338. This relative vacuum (or area of reduced pressure) helps to draw the compound in through the inlet port into the space (I). Then, with further rotation of the lobes 337*a* and 337*b*, the compound that was initially drawn in through the inlet port then becomes trapped between the tips of each lobe in the regions marked (II) in FIG. 13. The compound in the regions (II) therefore becomes driven by the rotating lobes around and along the interior surface of the cavity 340 before the compound finally reaches the region marked (III) where the compound is forced (under the elevated pressure created in this region (III) by the rotation of the lobes) out through the outlet port 339 which leads to the hose 400.

This is therefore how the pump 330 operates to pump the finishing compound from the tank 110 into the hose 400, whereupon the compound flows through the hose 400 and via the handle 500 into the tool 200 for application to the surface.

The handle 500 used in the apparatus 10 will next be described.

As shown in FIG. 14, FIG. 15, FIG. 16 and FIG. 17, the handle 500 is generally elongate and cylindrical. On one end of the handle 500, which is the end that is held closer to the user's body, there is a brake lever 520. The user can operate the brake lever 520 by hand to control the apparatus' brake mechanism, as discussed further below. Mounted on the opposite end of the handle 500 from the brake lever 520 (in this embodiment) is the tool 200. It will be appreciated that the length of the handle 500 can be varied to suit the user or intended application, with a shorter handle being provided if the apparatus is to be used in situations where a long handle is not required, or a longer handle can be provided in situations where this is required.

Figure 14:
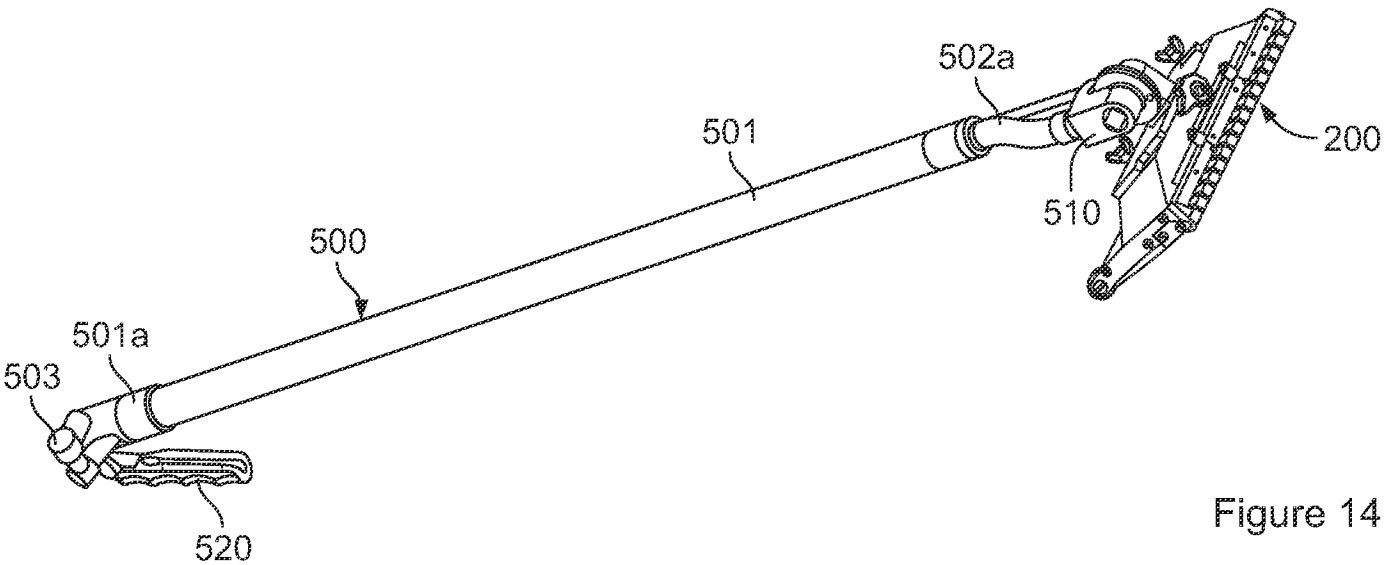
FIG. 14 illustrates the elongate handle portion of the apparatus in the embodiment in FIG. 4 to FIG. 10, including the brake lever on one end which a user can operate by hand. The brake lever is mounted on the opposite end of the handle from the end where the tool attaches (in this Figure the tool attached to the handle is a flat applicator tool, being a tool for applying finishing compound to a flat/planar surface). The brake lever is used to operate the apparatus' brake mechanism, which is a mechanism by which the user can temporarily fix/hold the orientation of the tool relative to the handle. This can help the user to better control the application of the compound to the surface using this flat applicator tool, and it can also assist the user to sweep the wheels of this particular applicator tool off the wall to reduce lap marks and other blemishes. This is discussed further below.
Figure 15:
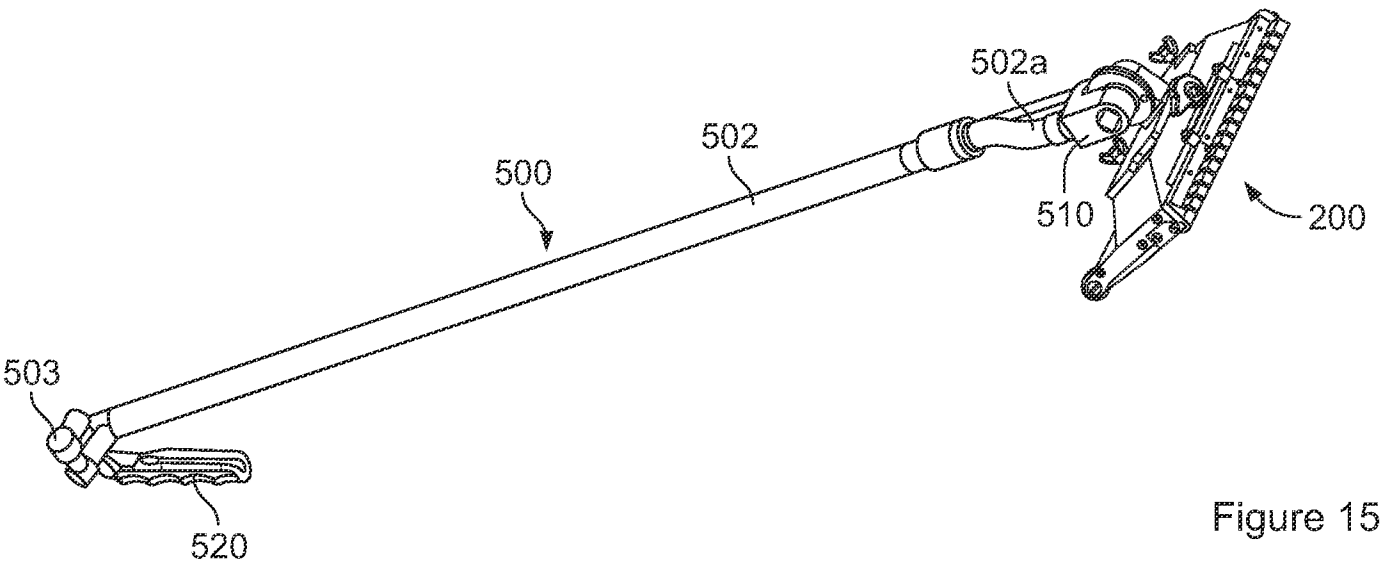
FIG. 15 also illustrates the elongate handle portion of the apparatus, and in fact
Figure 16:
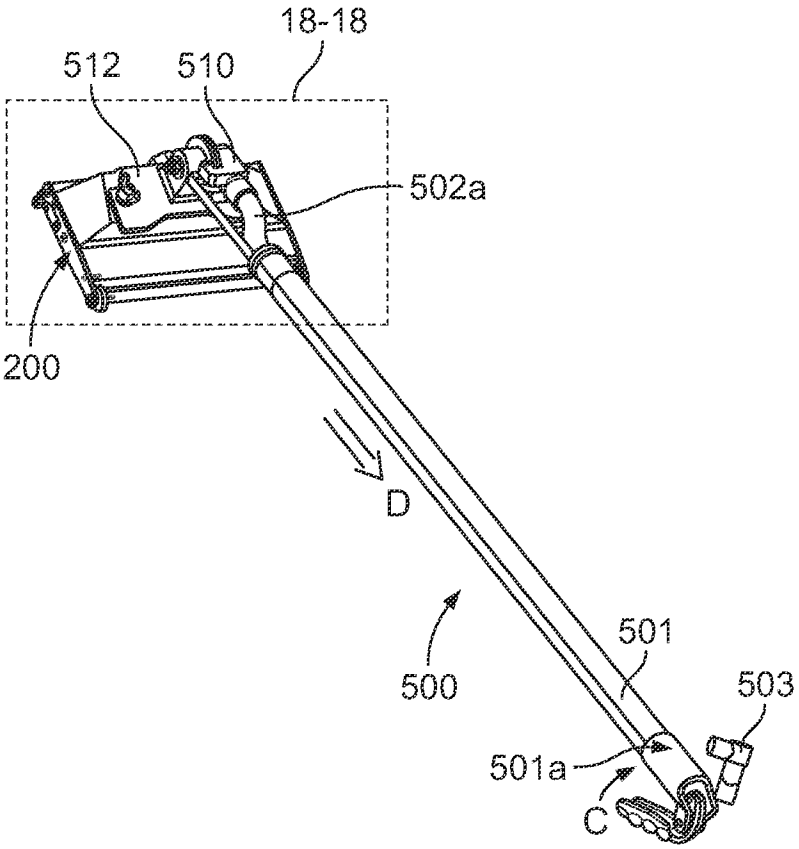
FIG. 16 again illustrates the elongate handle portion of the apparatus.

The main elongate handle portion of the handle 500 has a hollow outer casing 501. The internal conduit 502, which is what the compound flows through when it flows through the handle, is located inside the casing 501. In other words, the conduit 502 through which the compound flows when it flows through the handle is enclosed within the casing 501. The outer casing 501 therefore forms the outer surface of the handle which the user grasps by hand when the apparatus is in use. The outer casing 501 is shown in FIG. 14 and FIG. 16, but the internal conduit 502 is not visible in these Figures because it is hidden inside the casing 501. The conduit 502 is visible in FIG. 15 and FIG. 17 because, in those Figures, the casing 501 has been omitted so that the conduit 502 can be seen.

There is also an outer covering component 501*a* located on the same end of the handle as the brake lever 520 (and in fact covering component 501*a* partially covers part of the mechanism associated with brake lever 520). The covering component 501*a* also covers the (right angled and pivotable/swivelable) pipe fittings 503 through which the finishing compound flows from the hose 400 and into the handle 500.

After flowing along the length of the handle 500, through the conduit 502, the compound enters a further (slightly curved) connecting conduit 502*a* which joins the end of the main conduit 502 to the handle's pivotable/adjustable end 510. The above-mentioned brake mechanism is also associated with the handle's adjustable end 510, and the tool 200 is mounted to the mounting plate 512 which forms part of the adjustable end 510.

The adjustable end 510 of the handle 500, the brake mechanism, and the way in which the tool 200 (or likewise other tools that that might be mounted to the mounting plate 512 of the adjustable end 510) can attach to the mounting plate 512, will now be explained with reference to FIG. 18 through FIG. 22.

Figure 18:
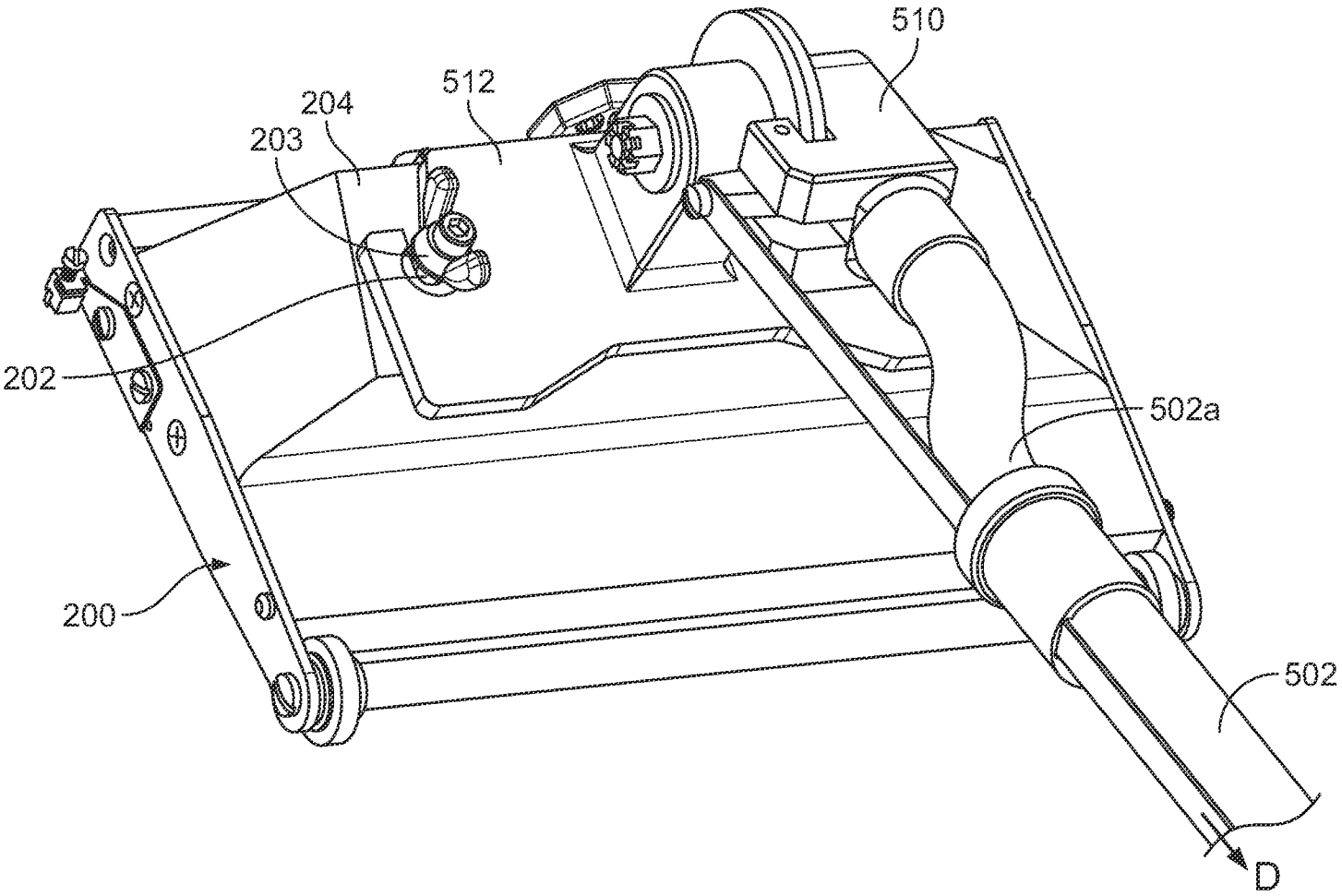
FIG. 18 is a close-up view of the area indicated 18-18 in FIG. 16.
Figure 19:
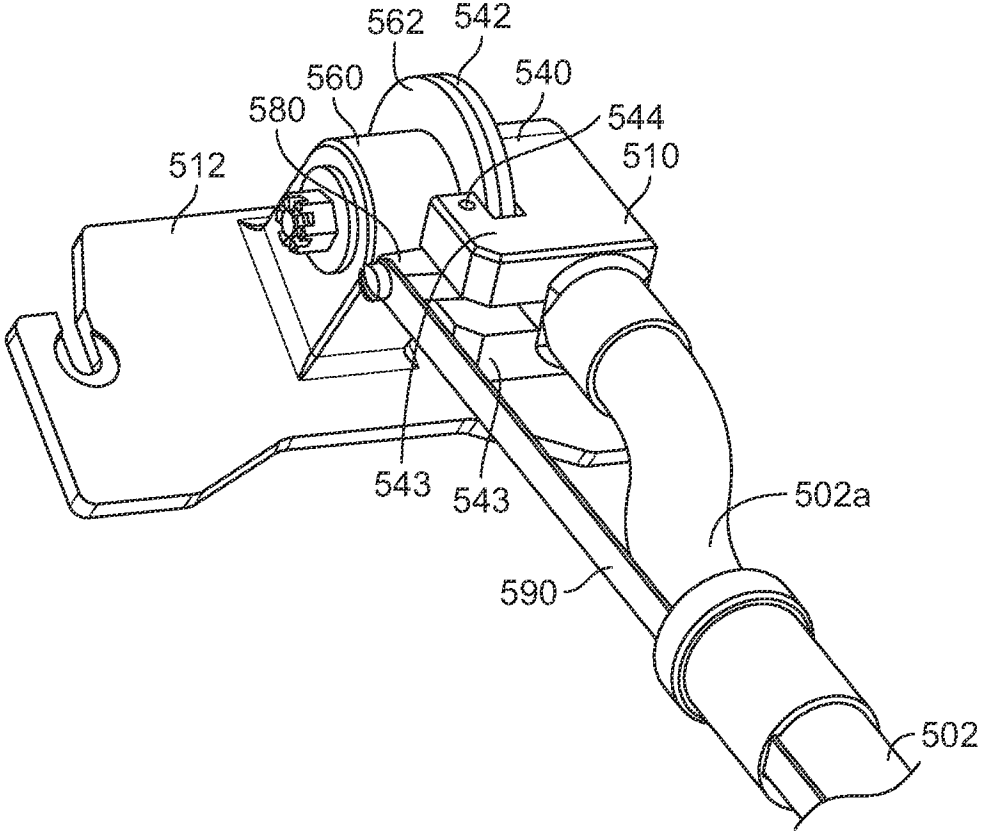
FIG. 19 is also a close-up view of the area indicated 18-18 in FIG. 16, except that unlike FIG. 16 and FIG. 18 (in which the flat applicator tool is shown on the end of the handle), the flat applicator tool has been removed from the end of the handle (and therefore is not shown) in FIG. 19.

The way in which the tool 200 (in this embodiment) attaches to the mounting plate 512 (thereby connecting the tool 200 to the end of the handle 500) can be clearly understood by comparing FIG. 18 with FIG. 19. FIG. 18 shows the tool 200 connected to the mounting plate 512 (such that the tool 200 is mounted to the end of the handle 500), whereas FIG. 19 illustrates the end of the handle 500 when the tool 200 has been disconnected from (or before the tool has been connected to) the mounting plate 512 (and therefore the tool 200 is not shown at all in FIG. 19). As these Figures illustrate, in this particular embodiment, the tool 200 has a pair of upstanding threaded rods 202 extending from the surface 204 of the tool that contacts with the mounting plate 512 when the tool 200 is connected thereto, and the mounting plate 512 has a pair of corresponding slots into which the threaded rods 202 are received. The tool 200 can be secured to the mounting plate 512 using wing nuts 203 (or conventional nuts could also be used) which are screwed onto the threaded rods 202 to clamp the tool 200 to the mounting plate 512, as shown in FIG. 18.

Figure 21:
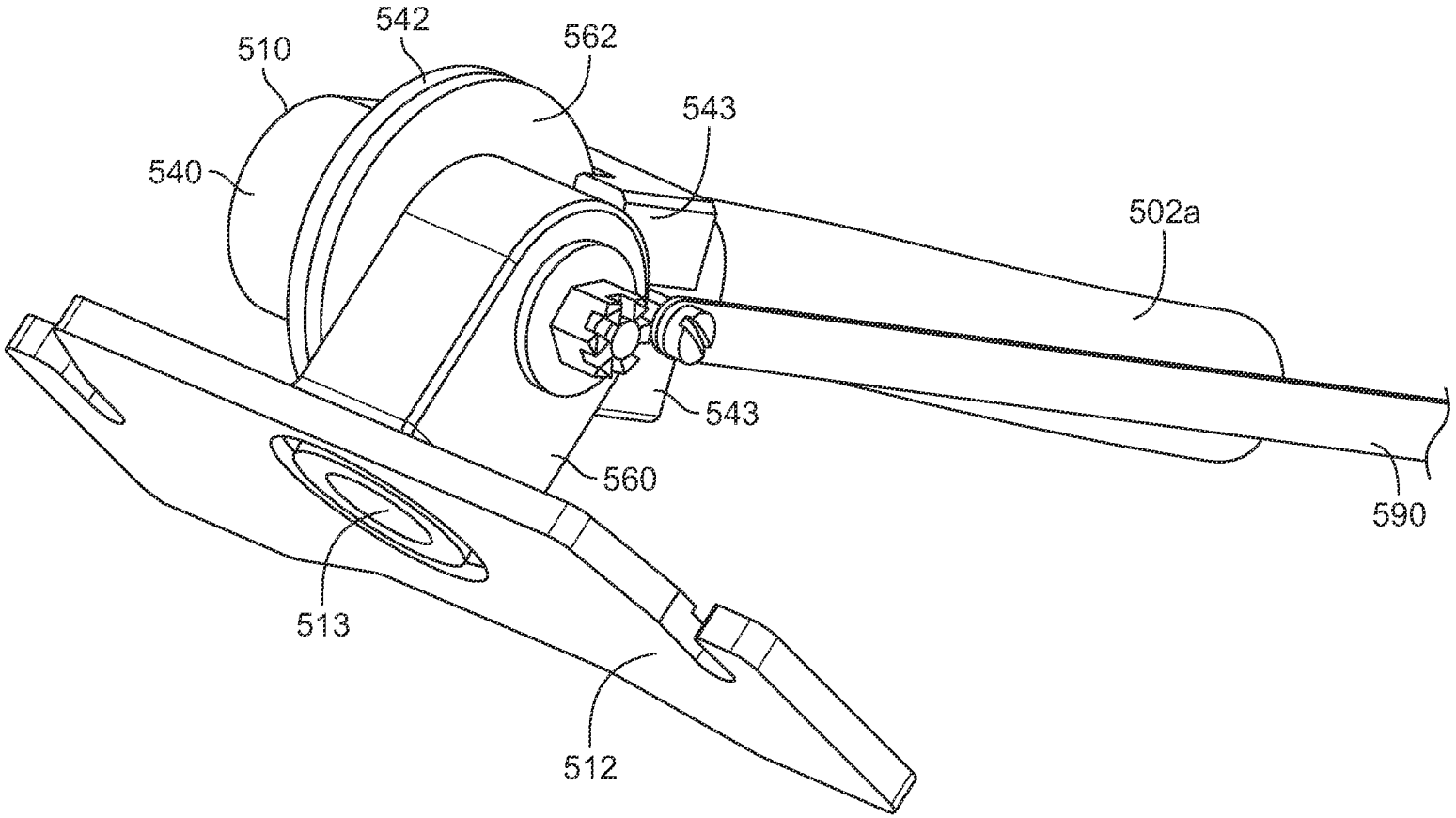
FIG. 21 again illustrates the same tool-end portion of the handle as and FIG. 19, and also with the tool removed from the end of the handle (just like in FIG. 19 and FIG. 20); however

The way in which the compound flows from the handle 500 and into the tool 200 can also be understood with reference to FIG. 21 and FIG. 23. FIG. 21 illustrates the end the handle 500 to which the tool 200 attaches but with the tool 200 removed from (or not connected to) the end of the handle. FIG. 21 also shows this tool-end of the handle from a point of view which enables the opening 513 through which the finishing compound exits the handle and enters the 200 tool to be seen. Thus, when the finishing compound is being pumped (by operating the pump as explained above) the compound flows along the handle's conduit 502 and into the pivotable end 510 via the connecting conduit 502*a*, and after passing through the pivotable end 510 the compound flows out through the opening 513 in the mounting plate 512 and (when the tool 200 is connected to the mounting plate 512) the compound then enters the tool 200 via the opening in the tool's surface 204 which is illustrated in FIG. 23 (and this opening in the surface 204 of the tool connects with the opening 513 in the mounting plate when the tool is connected thereto). After entering the tool via the opening in the surface 204, the pumped compound is then applied to the surface by the tool 200 (by the user pressing the tool against the surface and moving it along the surface).

The adjustable end 510 of the handle 500, and the brake mechanism, will now be explained.

As shown in FIG. 19, the pivotable end 510 of the handle includes a first part 540 and a second part 560. Both the first part 540 and the second part 560 have internal passages therein through which the finishing compound flows when it is pumped by the pump. The first part 540 is fixedly connected to the end of the connecting conduit 502*a*. Therefore, pumped compound enters the first part 540 from the connecting conduit 502*a*. The second part 560 is in fluid communication with the first part 540, such that pumped compound flows from the first part 540 into the second part 560. The second part 560 is also fixedly connected to the mounting plate 512, and the internal passage inside the second part 560 leads to the opening 513 in the mounting plate 512, such that compound exits the second part 560 via the opening 513 before entering the tool 200.

The second part 560 is also pivotable (i.e. it is able to pivot about the axis of bolt 570 to adopt different pivotal orientations) relative to the first part 540. In practice, the second part 560 will usually (i.e. at most times) be "free" in the sense that it is able to pivot relative to the first part 540 about the axis of bolt 570. However, the brake mechanism (to be discussed presently) can also be operated to hold/maintain the second part 560 and in a desired "fixed" position (and thus prevent it from moving/pivoting) relative to the first part 540. The brake mechanism can be operated to do this by the user squeezing the brake handle 520, which causes the second part 560 to be "held" at a particular position/orientation relative to the first part 540 and prevents the second part 560 (and the tool 200) from pivoting relative to the first part 540 while the brake mechanism is engaged. In this way, if the user wishes to temporarily fix/hold the orientation of the second part 560 relative to the first part 540 (for example, this will typically be done so that the second part 560 (and the tool 200 which is mounted thereon) remains secured in a fixed orientation relative to the first part 540 (and relative to the handle 500) before and while the user is beginning to press the tool against the surface before commencing a "run", and also as the user removes the tool from the surface at the end of a "run", but the brake will not usually be engaged during the "run" while the user is moving the tool along the surface to apply compound to the surface), the user can first orient the tool 200 and the second part 560 at the desired orientation relative to the first part 540 and the handle 500, and the user can then squeeze the brake handle 520 thereby causing the second part 560 (and the tool 200) to be held relative to the first part 540 (and relative to the handle 500) at that orientation. The user can then keep the tool 200 and the second part 560 in that desired orientation for as long as required by continuing to squeeze the brake lever 520. When the user no longer needs (or requires) the tool 200 and the second part 560 to stay in that "fixed" position/orientation, they can release the brake lever 520, whereupon the second part 560 and the tool 200 will once again become "free" in the sense that they are once again able to pivot relative to the first part 540 about the axis of bolt 570.

The brake mechanism will now be explained in greater detail.

Figure 20:
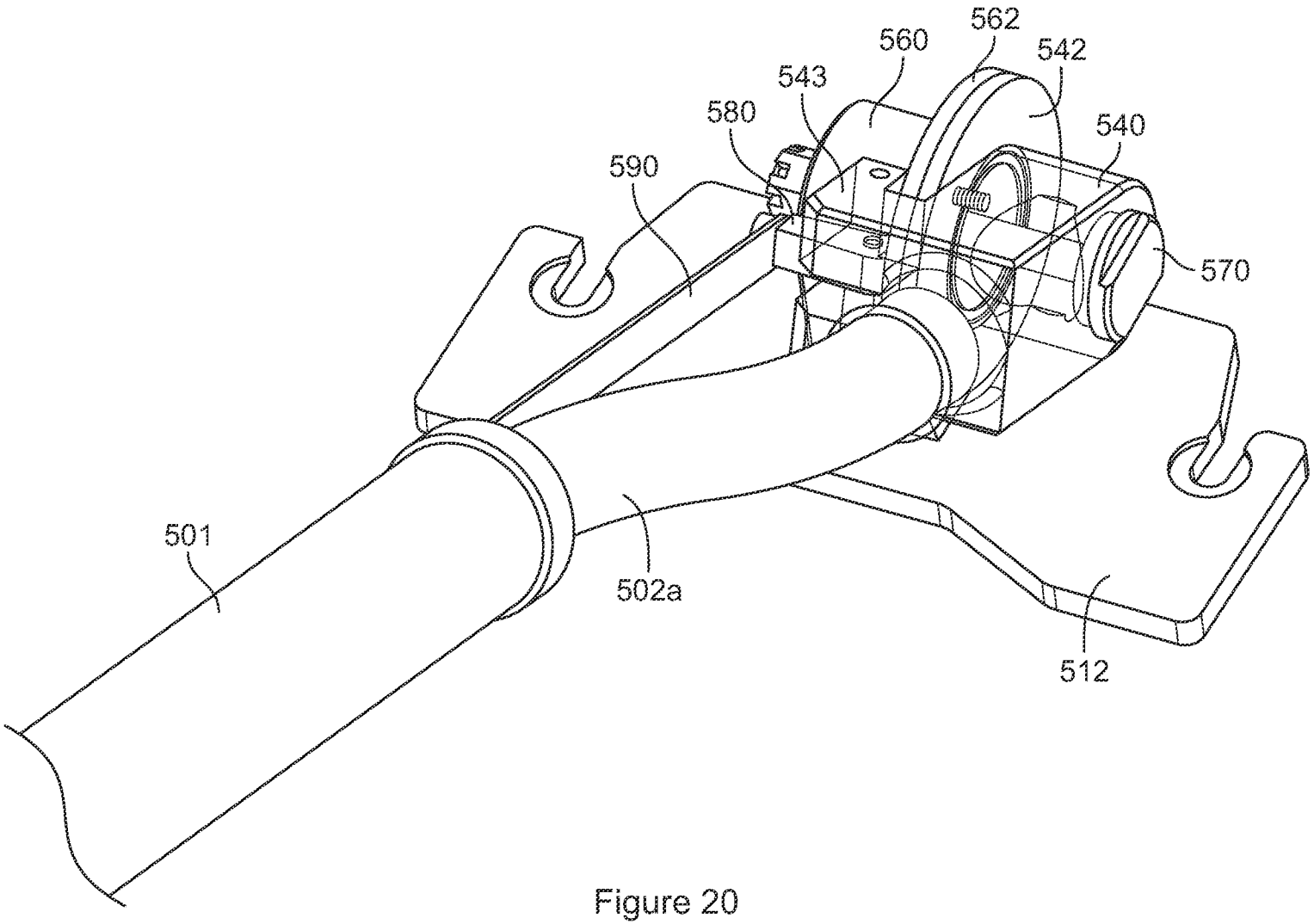
FIG. 20 is similar to FIG. 19 in that it shows the same end of the handle (to which the tool can be mounted); however

FIG. 20 is similar to FIG. 19 in that it shows the pivotable end 510 of the handle including the first part 540 and the second part 560. However, in FIG. 20, the first part 540 has been made to appear transparent in order that other parts and components may be seen. In particular, it can be seen that there is a bolt 570 which extends through both the first part 540 and the second part 560. Thus, the first part 540 and the second part 560 are held together by the bolt 570 (and the nut on the end thereof). However, as mentioned above, when the user squeezes the brake handle 520 to engage the brake mechanism, the second part 560 (plus any tool mounted to the mounting plate 512) becomes held at the particular orientation it was in relative to the first part 540 when the brake mechanism was engaged, and thus the second part 560 (and the tool) are unable to pivot relative to the first part 540 about the longitudinal axis of the bolt 570 while the brake mechanism remains engaged.

FIG. 20 (and also FIG. 19) shows that there is a first annular contact plate 542 which is fixedly connected to (or formed as part of) the first part 540, and likewise there is a second annular contact plate 562 which is fixedly connected to (or formed as part of) the second part 560. These Figures also show that there is a camming member 580, and a connecting rod 590. One end of the connecting rod 590 connects to the outer end of the camming member 580, and the other end of the connecting rod connects to the brake handle 520. Accordingly, when the user squeezes the brake handle 520 (as indicated by arrow "C" in FIG. 16), this pulls on the brake handle 520 (as indicated by arrow "D"). Therefore, the movement created by the user squeezing the brake lever 520 is transmitted via the connecting rod 590 (as indicated by arrow "D") to cause movement of the camming member 580, as discussed below.

As shown in FIG. 19, and also in FIG. 20 the camming member 580 is located between a pair of arm portions 543 on the first part 540. The camming member 580 is also connected to the arm portions 543 via a pin 544 such that the camming member 580 is able to pivot slightly relative to the arm portions 543 (and hence relative to the first part 540) about the axis of the pin 544. Next, as shown in FIG. 22 (which is a cross-sectional view), the inner end of the camming member 580 has a camming surface which comes into contact (and camming engagement) with the outer side of the second annular contact plate 562 when the brake mechanism is engaged.

Figure 17:
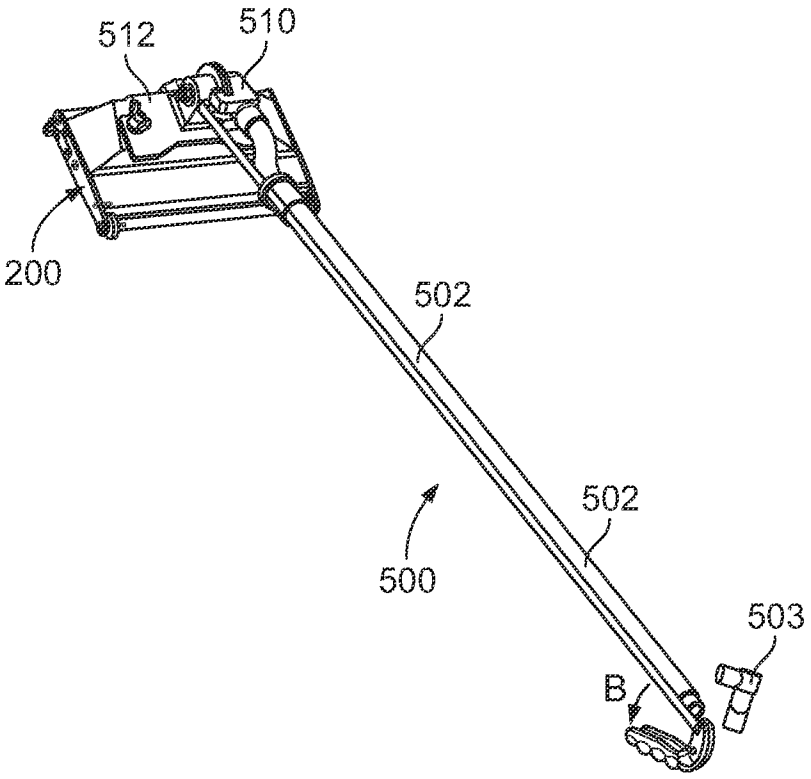
FIG. 17 yet again illustrates the elongate handle portion of the apparatus.

Normally, the brake handle 520 is biased (e.g. by a spring or the like) away from the handle 500 to which it is mounted, as indicated by arrow "B" in FIG. 17. Accordingly, because the brake handle 520 is connected to the camming member 580 by the connecting rod 590, it follows that this bias also causes the camming member 580 to be normally biased away from the position in which it is shown in FIG. 22. In other words, normally, when the user is not squeezing the brake lever 520, the camming member 580 is not in the exact position/orientation in which it is shown in FIG. 22. Therefore, normally, the camming surface on the camming member 580 is not rotated (as it is in FIG. 22) to press firmly against the side of the second annular contact plate 562. Rather, the camming member 580 is normally pivoted slightly in comparison (i.e. it is normally pivoted slightly compared to the position in which it is shown in FIG. 22, and more specifically it is normally pivoted slightly in a direction opposite to the direction of arrow "E") such that the camming surface on the camming member 580 does not press firmly (or as firmly) against the second annular contact plate 562.

Figure 22:
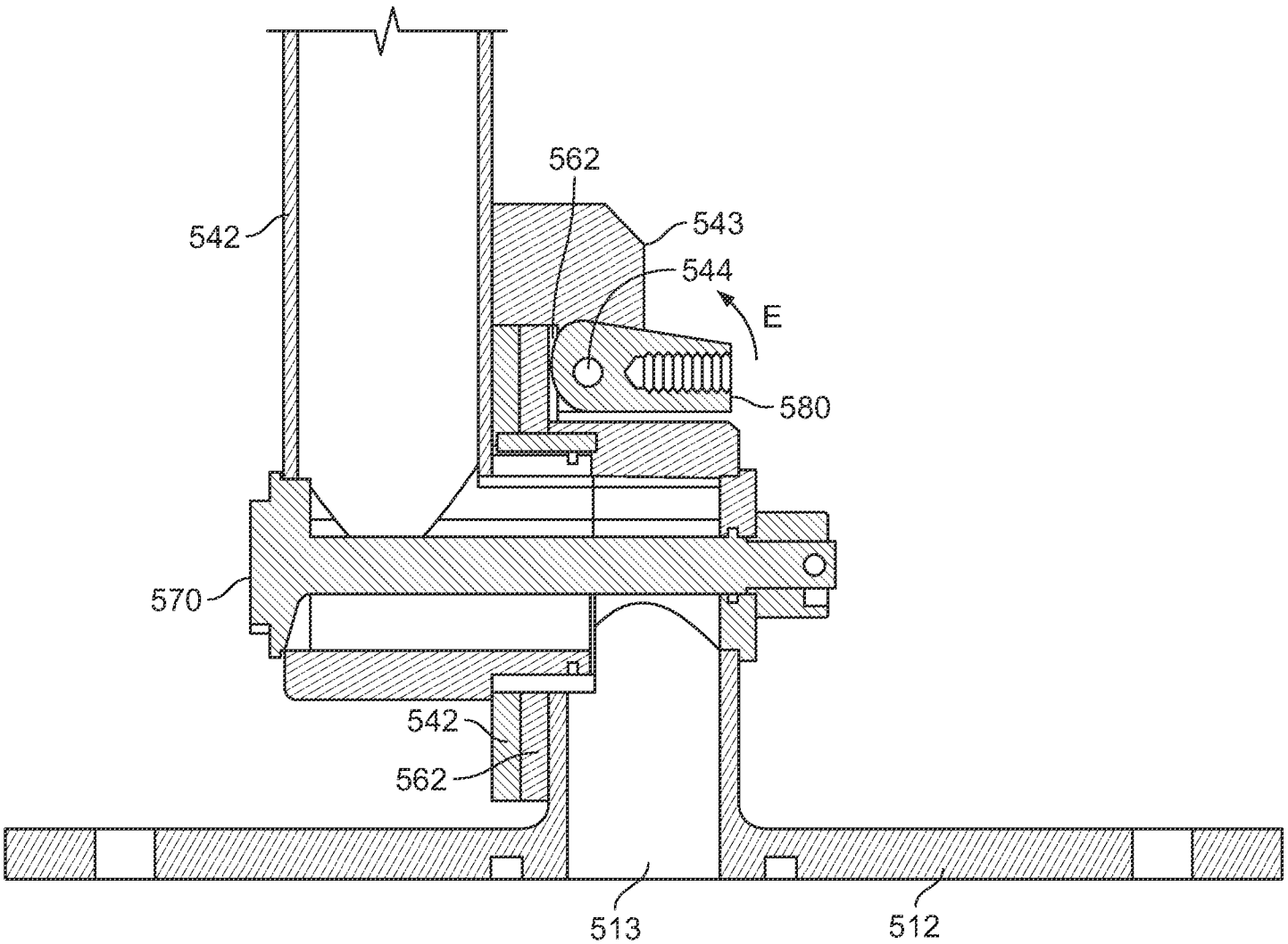
FIG. 22 is a cross-sectional view taken through the tool-end portion of the handle when the tool mounting plate has been oriented so as to be perpendicular to the main longitudinal axis of the handle.

However, when the user squeezes the brake handle 520 against its normal bias (causing the brake handle 520 to move in the direction indicated by arrow "C" in FIG. 16), this causes the connecting rod 590 to be pulled in the direction indicated by arrow "D", and this in turn causes the camming member 580 to pivot slightly (about the pin 544) in the direction indicated by arrow "E" in FIG. 22. When the camming member 580 pivots slightly in the direction indicated by arrow "E", this causes the camming surface on the camming member 580 (due to the shape of that camming surface) to press more firmly against the side of the second annular contact plate 562. Accordingly, when the brake lever 520 is squeezed thereby causing the camming member 580 to pivot as just described (i.e. by a small amount in the direction shown by arrow "E") and thereby cause the camming surface to press firmly against the second annular contact plate 562, the consequence is that the second annular contact plate 562 becomes pressed firmly against the first annular contact plate 542, thereby causing the second annular contact plate 562 to be held in position relative to the first annular contact plate 542. Thus, the second part 560 (along with any tool mounted thereto) becomes held in fixed position relative to the first part 540 (and the handle 500).

However, when the user then releases the brake lever 520, i.e. such that the brake lever 520 pivots back out under its natural bias in the direction indicated by arrow "B", this will then cause the connecting rod to be pushed back (i.e. to move in a direction opposite to arrow "D"), whereupon the camming member 580 will also then pivot slightly back (i.e. it will rotate back slightly in a direction opposite to arrow "E") such that the camming surface once again pushes less firmly against the side of the second annular contact plate 562, thereby removing the pressure that held the second annular contact plate 562 firm against the first annular contact plate 542 and thereby once again releasing the second part 560 (and any tool connected thereto) to be able to move/pivot relative to the first part 540.

As mentioned above, the user will generally squeeze the brake lever 520 to thereby "hold" the second part 560 (and any connected tool) relative to the first part 540 only after the second part 560 and the tool have been moved into the desired orientation relative to the first part 540, and typically this will be before and while the user is beginning to press the tool against the surface before commencing a "run", and also as the user removes the tool from the surface at the end of the "run", but the brake lever will not usually be squeezed to engage the brake during the "run", i.e. while the user is moving the tool along the surface to apply compound to the surface.

The way in which finishing compound is applied to a flat surface using the particular tool 200, which it will be recalled is a flat applicator tool, will be described with reference to FIG. 23 to FIG. 25. Note that FIG. 24 is mostly identical to FIG. 23, except that the blade tension adjuster knob visible in FIG. 23 is omitted from FIG. 24, and the main body of the tool 200, which appears solid in FIG. 23, has been made to appear transparent in FIG. 24—this is simply for illustrative purposes and so that certain internal features within the main body can be seen.

As explained above, when the finishing compound is being pumped (by operating the pump as has been explained), the compound flows along the handle's conduit 502 and into the pivotable end 510 via the connecting conduit **502*a*, and after passing through the pivotable end 510 the compound flows out through the opening 513 in the mounting plate 512 and (when the tool 200 is connected to the mounting plate 512) the compound then enters the tool 200 via the opening in the tool's surface 204 which is visible in FIG. 23. This opening in the surface 204 of the tool aligns with the opening 513 in the mounting plate when the tool is connected to the mounting plate. After entering the tool via the opening in the surface 204**, the pumped compound is then applied to the surface by the tool.

More specifically, before the user commences applying compound to the wall by operating the pump and moving the tool 200 along the surface, the user may first pump compound into the tool sufficiently to substantially fill the elongate cavity within the main body of the tool. This elongate cavity is visible in FIG. 24 and also from the underside of the tool in FIG. 25. The elongate cavity is the cavity within the main body of the tool that the opening in the surface 204 leads to. Thus, the user may not actually begin using the apparatus to apply compound to the surface until this elongate cavity within the tool is substantially filled with compound. Ensuring that this cavity is filled with compound before starting can help to ensure that, when the user does subsequently commence operating the pump while moving the tool 200 along the surface, the compound is applied smoothly and evenly across the full width of the tool and without air bubbles, etc. Hence, once the elongate cavity within the main body of the tool has been filled with compound, the user may then press the underside of the tool against the surface and also move the tool along the surface, operating the pump while doing so, such that as the tool moves along the surface, the compound which is then progressively being pumped from the tank into the tool becomes applied evenly to the surface by the tool. Note that the tool's blade functions to ensure that the compound exiting the elongate cavity onto the surface is spread and applied onto the surface evenly and with the desired thickness. (In this regard, the way in which the blade of the tool 200 works is identical to the flat applicator tool mentioned in the Background section and shown in FIG. 1, which has an identical blade mechanism (and also a similar mechanism for adjusting the tension in the blade)).

It should be noted that the tool 200 also has a pair of rollers (which are joined by connecting rod) on the leading side of the tool. These rollers help the tool to move along the surface smoothly and without causing dents or scratches or other blemishes as it moves.

It should also be understood that an important function of the brake mechanism (described above), and in particular an important way in which the brake mechanism is often used/employed by users, is that the brake mechanism can be used to "hold" the tool in a fixed orientation relative to the handle not only while the user is using the tool by moving it along the surface to apply compound to the surface, but in addition to this the user will also often continue to keep the brake mechanism engaged to keep the tool "held" in fixed relation to the handle when the user sweeps the tool off and away from the surface (i.e. after the user has finished applying a particular length of compound to the surface). The user's ability to keep the tool in fixed relation relative to the handle (by keeping the brake mechanism engaged) as they finish applying a particular length of compound to the surface and then sweep the tool off the surface significantly assists the user's ability to also sweep the rollers of the tool off the surface, thereby preventing the rollers from causing lap marks or other blemishes.

It is also important to remember that, as mentioned above, the particular flat applicator tool 200 which is shown mounted on the end of the handle 500 in the embodiment of the invention depicted in FIG. 4 to FIG. 18, and which is the tool shown in FIG. 23 to FIG. 25, is only one possible tool (from amongst a wide range of tools) that could be mounted to and used with the apparatus 10. Other kinds of tools that could also be mounted to the end of the handle 500 and used with the apparatus 10 includes, for example (but without limitation), other kinds or sizes of the flat applicator tools, or tools configured so as to allow the compound pumped from the tank to be applied evenly and smoothly in corners, such as a concave (or internal) e.g. 90° or other concave corner, or onto a convex (or external) e.g. 270° or other convex corner, etc.

Turning next to FIG. 26, FIG. 27 and FIG. 28, these show an alternative type of handle 700, different to the handle 500 described above. The handle 700 does not allow flat applicator (or other) tools to be mounted thereto in the same way as the handle 500 described above. In other words, the handle 700 cannot be used with the same kinds of tools as the handle 500. Instead, the handle 700 shown FIG. 26, FIG. 27 and FIG. 28 is used in situations, and in ways, that are similar to the tool shown in the images of FIG. 3. Accordingly, similar to the tool shown in FIG. 3, different fittings/attachments (in fact the same fittings and attachments that would attach to the tool in FIG. 3) can be connected to the externally-round (but internally hollow) metal connector located on the tip end of handle 700.

The way in which the handle 700 can be used with (or as part of) the apparatus (instead of the handle 500 and any tool mounted to the handle 500) will be relatively self-evident. Essentially, the hose 400 can connect directly (or possibly the hose may connect via a connector similar to 503) to the end of the handle 700, such that compound that is pumped from the tank 110 flows into the handle 700 via the hose 400, before being applied to the surface in a similar manner to the way in which this is done using the tool in FIG. 3 (except of course that, unlike the tool in FIG. 3, the user is not required to manually pump the compound using the plunger like arrangement which the tool in FIG. 3 has).

Relevantly, if the handle 700 is used with (or as part of) the apparatus instead of the handle 500, the way in which the user can control the operation of the pump may be the same as described above. That is, controls similar to the controls 303 shown in FIG. 4, used for controlling the electric motor 310, may be mounted to the handle 700 in a similar way to the way in which the controls are mounted to the handle 500. In FIG. 4, the controls 303 are shown mounted on the handle 500 toward the lower end thereof. In this position, the controls 303 are able to be operated by one of the user's hands. The controls may be mounted in a similar position, and operated in a similar way, on the handle 700.

Turning next to FIG. 29, this Figure shows a wearable apparatus in accordance with a different embodiment to the one shown in FIG. 4 to FIG. 18. As will be evident, the wearable apparatus in the embodiment shown in FIG. 29 is similar to (in fact it is the same as) the embodiment shown in FIG. 4 to FIG. 18, except that the handle 500 and flat applicator tool 200 which form part of the embodiment shown in FIG. 4 to FIG. 18 are replaced by a taping tool 800 in the embodiment in FIG. 29. The taping tool 800 itself is also shown in FIG. 30, FIG. 31, FIG. 32 and FIG. 33.

Figure 1:
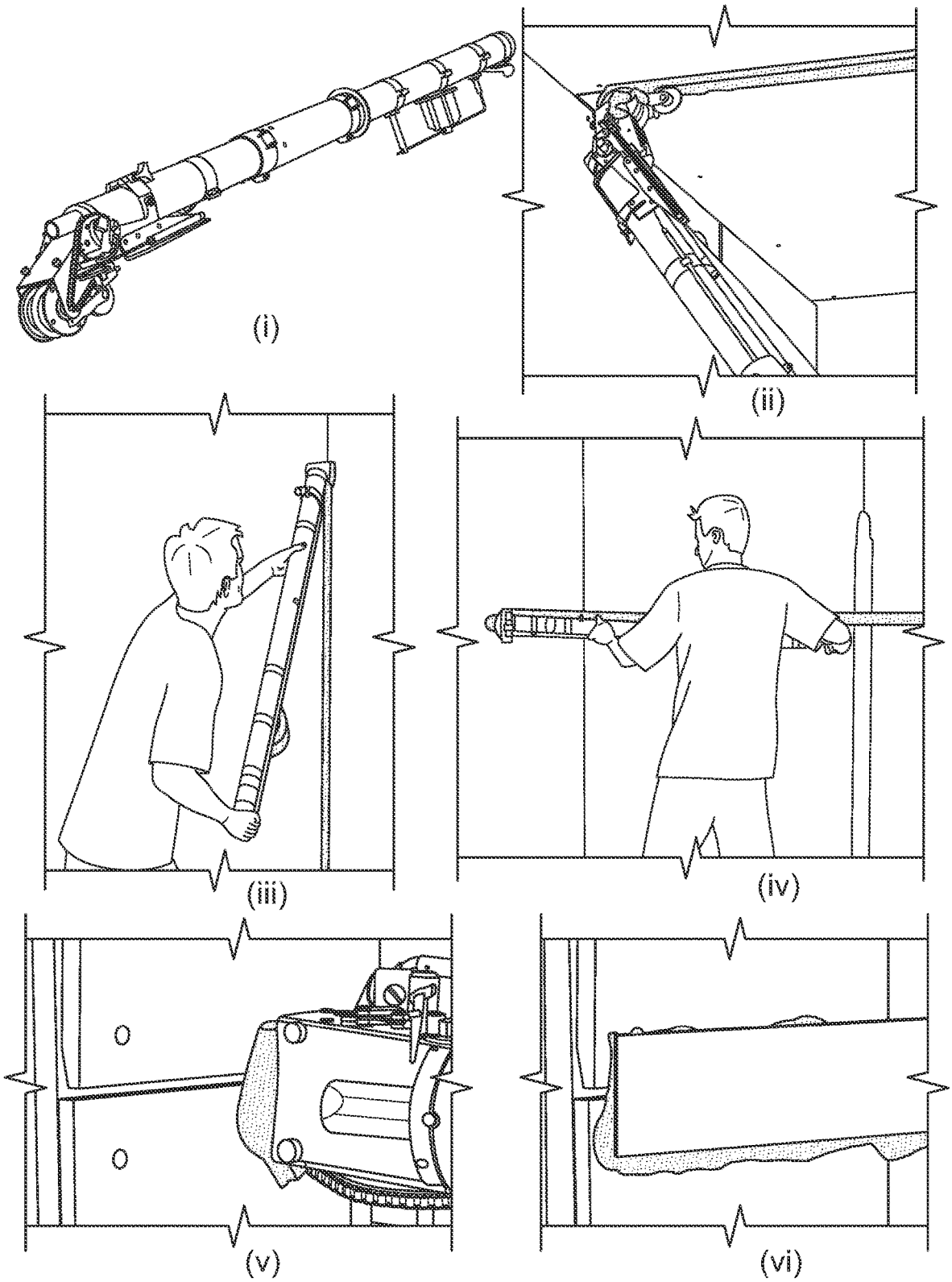
FIG. 1 contains a number of images which illustrate an existing form of automatic taping tool, and also the use of that tool, to apply compound to fill, and also apply finishing tape to cover, the gap between adjacent plasterboards. In other words, FIG. 1 contains a number of images which illustrate an existing taping tool (and the use of that tool), which simultaneously applies both the tape and also the compound.
Figure 2:
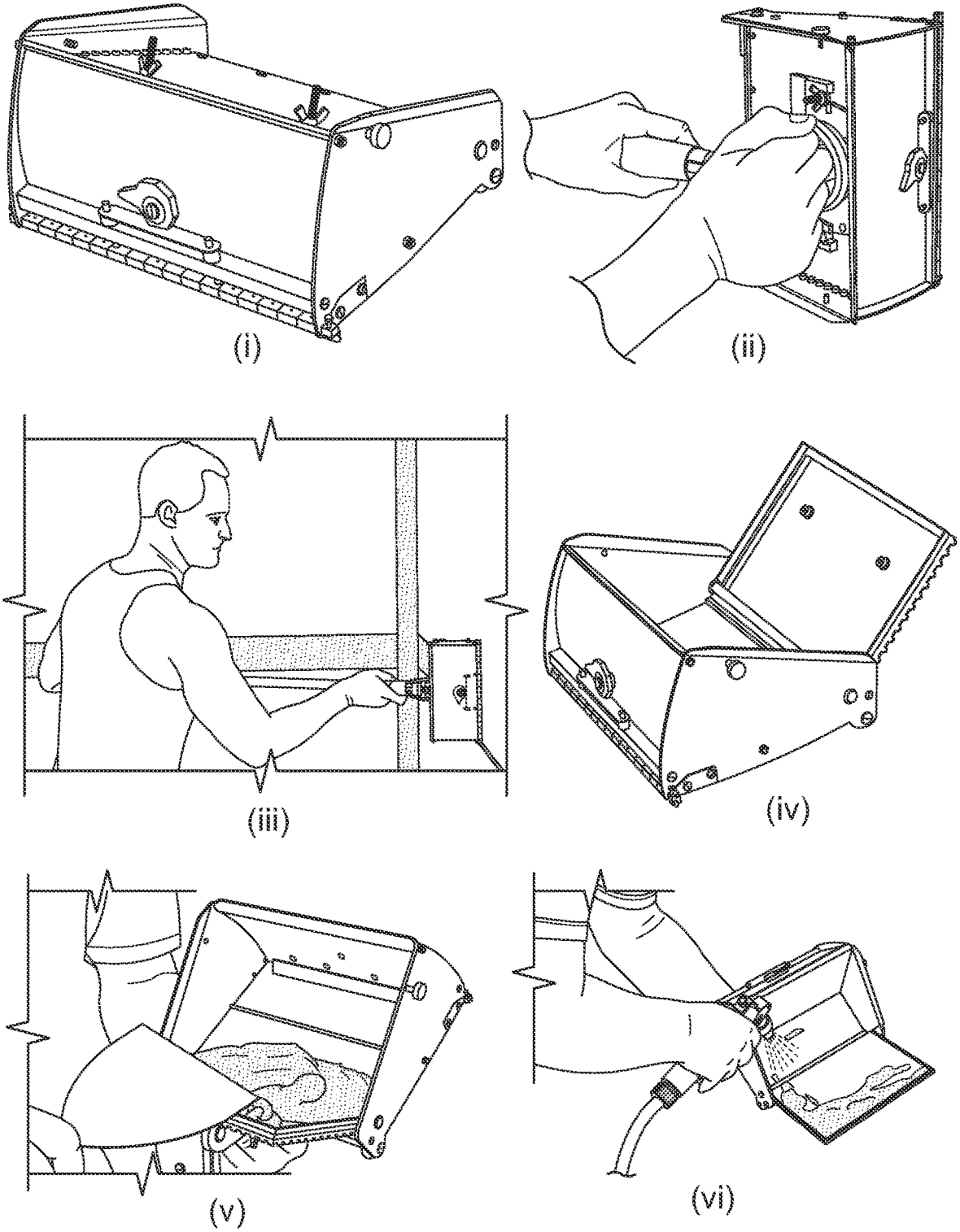
FIG. 2 contains a number of images which illustrate an existing form of automatic "flat box" finishing tool, and also the use of that tool. The "flat box" finishing tool shown in FIG. 2 is for applying a layer of finishing compound, for example, over the finishing tape to hide any edges and ridges associated with the tape, although the "flat box" tool shown can also be used to apply the finishing compound directly onto the drywall surface (i.e. and not over tape) to cover any nail holes or other blemishes.

In many respects, the configuration of the taping tool 800, and the way it works, is similar to the automatic taping tool described in the Background section with reference to the various images in FIG. 1.

For example, it can be seen from FIG. 29 that taping tool 800 (just like the previous taping tool shown in the images of FIG. 1) is able to receive and mount a roll of the paper tape. The roll of tape is mounted towards the lower end of the tool on the spool 820, just like in the tool in FIG. 1. Also, when the taping tool 800 is used as part of the apparatus in FIG. 29 (i.e. when the apparatus in FIG. 29 is in use) and the user moves the head of the tool 800 along the surface, the tape unrolls from the roll on the spool 820 and is fed up through a tape guide 830 just below the tool head (the tape guide 830 is visible in FIG. 31 and FIG. 33) and then over and off the head of the tool 800.

Also similar to the tool in FIG. 1, there are three circular (disc-like) rollers 840 at the head of the tool 800. When the tool 800 is in use, the user presses the head of the tool against the surface. More specifically, when the user presses the head of the tool 800 against the surface, the paper tape that is being dispensed by the tool 800, and specifically the portion of the tape which is at that time passing over the tool head, is pressed against the surface by the rollers 840. Therefore, when the user presses the end of the tool 800 against the surface, the user is actually pressing the rollers 840 against the tape which is passing over and off the tool head, such that the tape passing over and off the tool head is actually pressed against the surface by the rollers 840. In other words, as the user moves the tool head along the surface, the rollers 840 roll along pressing the tape (which is coming off the tool) against the surface. To this extent, the tool 800 is similar to the previous taping tool in FIG. 1.

Also, as with the taping tool in FIG. 1, it is also true with the taping tool 800 that just before (often about e.g. 100 mm before) the user reaches the place where the application of tape and compound is to finish, the user actuates a tape cutting mechanism on the tool (this is done by pulling down on the control tube 850) which cuts the tape, but leaves a short length (approx. 100 mm) of tape remaining to be applied by the tool, and after that the user continues to move the tool along for the remaining distance to apply the remaining amount of tape (and the compound thereon) to the surface, and thereafter the user then lifts the tool away from the surface. The way the tape cutting mechanism on the tool 800 actually works when the use of pulldown on the control tube 850 is essentially the same as for the tool in FIG. 1 and therefore need not be discussed in detail.

Thus, in many respects, the operation of the taping tool 800 is the same as the operation of the tool in FIG. 1, which is described and shown in more detail in the video which can be viewed at: https://www.youtube.com/watch?v=XLME7cVrInA. (This video was also mentioned in the Background section above.)

However, there are also a number of important differences between the taping tool 800 and the taping tool in FIG. 1. For example, it will be recalled from the Background section above that the tool in FIG. 1 incorporates a chain and there are number of mechanisms linked to (and driven by) the chain. In particular, the chain is connected to the rollers such that, with the tool in FIG. 1, as the rollers roll over the tape as the tool moves along the surface, the rotation of the rollers causes the chain to rotate/circulate on the tool, and the chain connects to (and drives) drive wheels within the tool head, and the rotation of these drive wheels in turn causes a piston, which is also within the tool in FIG. 1, to move towards the head end of the tool. This movement of the piston within the tool in FIG. 1 is what causes the compound to be dispensed at the head end of that tool.

The tool 800 does not include the chain or any of the associated mechanisms used by the tool in FIG. 1 to dispense the compound. The reason is because, similar to the previous embodiment described in in FIG. 4 to FIG. 18, the taping tool 800 is connected by the hose 400 to the backpack portion of the apparatus. Consequently, with the taping tool 800, the way in which compound is caused to be dispensed is the same as for the embodiment described with reference to in FIG. 4 to FIG. 18. That is, controls (which are not shown in any of FIG. 29 to FIG. 33 but which would be similar to the controls 303 described above) would be mounted on the shaft of the tool 800 to be operated by the user. Thus, when these controls are operated (i.e. when the user operates the apparatus to cause compound to be pumped from the tank 110, via the hose 400, and into the tool 800, as the user is pressing the head of the tool 800 against the surface and moving it along the surface, the tool 800 operates to automatically cause compound (which is being pumped through the tool) to be dispensed from the end of the tool and onto the tape. More specifically, as the user moves the tool along the surface while the user is operating the pump to pump compound, the tool automatically causes compound to be dispensed from the upper end of the main tube of the tool 800 (the compound is dispensed underneath the cover plate 860), and the compound dispensed beneath the cover plate 860 therefore becomes (in fact the cover plate 860 causes the compound to be) applied onto one side of the tape (the side of the tape that becomes stuck to the surface) as the tape passes over the rollers 840 on the tool head. Therefore, as the tape passes over the tool head and off the tool as the tool moves, the tape (with the compound then applied to the side that contacts and adheres to the surface) is pressed against the surface by the tools rollers 840 which roll along the surface, thereby pressing the tape (with the compound applied to it) that is coming off the tool against the surface as the tool moves.

Importantly, because the taping tool 800 does not include the chain or any of the associated mechanisms used by the tool in FIG. 1 to dispense the compound, the tool 800 is comparatively much lighter than the tool in FIG. 1.

It will be noted that there is also a lever handle 870 mounted on the opposite end of the tool 800 from the tool head. It is important to note that, unlike the embodiment described above with reference to FIG. 4 to FIG. 18, the lever handle 870 does not operate a form of brake mechanism. On the contrary, the lever handle 870 is used to control the extension and retraction of the "creaser wheel" 890. The creaser wheel 890 is a trailing roller which can be used to press against the tape that has already passed over the main rollers 840. The creaser roller can also be caused to pivot/extend out, as shown by arrow "F" in FIG. 33. Basically, the creaser roller 890 is caused to extend out in the direction of arrow "F" by squeezing the lever handle 870, and the more the user squeezes the lever handle 870, the further the creaser roller 890 pivots/extends out. Conversely, if the user squeezes the lever handle 870 less, the creaser wheel 890 will pivot/extend back in (opposite to arrow "F") somewhat, and if the user releases the lever handle 870 altogether, the creaser wheel 890 will retract all the way back. The creaser roller can be used to apply additional pressure to tape that has already passed off the main rollers 840 (this can be useful when applying tape to e.g. ceilings), and the creaser wheel 890 can also be used to help press/fold tape into corners if the tool 800 is being used to apply tape into a corner.

In this specification, the term "comprising" is (and likewise variants of the term such as "comprise" or "comprises" are) intended to denote the inclusion of a stated integer or integers, but not necessarily the exclusion of any other integer, depending on the context in which the term is used.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

What is claimed is:

1. An apparatus for use in drywall plastering for applying a pumpable finishing compound, the apparatus comprising a tank for storing the pumpable compound, an applicator for applying the compound to a surface or feature to which the compound is to be applied, a pump for pumping the compound from the tank to the applicator for application to the surface or feature, an electric motor which drives the pump, a battery that powers the electric motor, and a conduit through which the compound is pumped from the tank to the applicator, wherein the tank, pump, motor and battery of the apparatus are able to be worn by a user, or carried on a part of the user's body, while the apparatus is in use for applying the compound to the surface or feature, and wherein the pumpable compound is received directly into the tank by being poured, pumped, or otherwise inserted into the tank, the tank has a lower end which is closed except for an outlet through which the compound can flow when it is pumped out of the tank, and the apparatus further comprises a piston inside the tank, and when the apparatus is in use, compound in the tank is at a level between the lower end of the tank and the piston, and as compound is pumped out of the tank and the level of compound within the tank drops, the piston moves down and remains in contact with the compound from above.

2. The apparatus for use in drywall plastering as claimed in claim 1, wherein the apparatus includes a pair of shoulder straps which enable parts of the apparatus that are able to be worn by a user, or carried on a part of the user's body, to be worn like a backpack.

3. The apparatus for use in drywall plastering as claimed in claim 1 wherein the conduit through which the compound is pumped from the tank to the applicator includes a flexible hose.

4. The apparatus for use in drywall plastering as claimed in claim 1, wherein the applicator for applying the compound to the surface or feature comprises a finishing tool.

5. The apparatus for use in drywall plastering as claimed in claim 1, wherein the applicator comprises a finishing tool for applying the compound to a flat surface.

6. The apparatus for use in drywall plastering as claimed in claim 1, wherein the applicator comprises a finishing tool for applying the compound to a concave or internal corner where two surfaces meet.

7. The apparatus for use in drywall plastering as claimed in claim 1, wherein the applicator comprises a finishing tool for applying the compound to a convex or external corner or ridge where two surfaces meet.

8. The apparatus for use in drywall plastering as claimed in claim 1, wherein the applicator comprises a taping tool for applying the compound and finishing tape simultaneously.

9. The apparatus for use in drywall plastering as claimed in claim 4, wherein the apparatus includes a handle through which the compound can be pumped, and the tool is mounted on one end of the handle such that pumped compound is delivered to the tool via the handle.

10. The apparatus for use in drywall plastering as claimed in claim 9, wherein one end of the hose is connected to the pump and the other end of the hose is connected to the opposite end of the handle from the tool.

11. The apparatus for use in drywall plastering as claimed in claim 1, wherein the tank is elongate in shape and is oriented so that its long dimension is substantially vertical when the apparatus is being worn or carried by the user.

12. The apparatus for use in drywall plastering as claimed in claim 9, wherein the apparatus is configured such that the orientation of the tool, which is on the end of the handle, is able to be adjusted relative to the handle.

13. The apparatus for use in drywall plastering as claimed in claim 12, wherein the apparatus includes a brake mechanism which normally does not hold the tool in a fixed position/orientation relative to the handle, but the brake mechanism can be engaged by the user to hold the tool in a fixed orientation relative to the handle.

14. The apparatus for use in drywall plastering as claimed in claim 13, wherein the brake mechanism is operable by a brake lever, and when the brake lever is operated to engage the brake mechanism a camming mechanism is engaged to cause a part of (or a part which is associated with) the tool (or part of the apparatus to which the tool connects) to press against part of (or a part associated with) the handle, thereby causing the tool to be held in a fixed orientation relative to the handle.

15. The apparatus for use in drywall plastering as claimed in claim 1, wherein the pump is a lobe pump which has a pair of lobes that rotate in opposite directions within a chamber inside the pump to pump compound that enters the pump from the tank into the conduit that leads to the applicator.

16. The apparatus for use in drywall plastering as claimed in claim 1, wherein the tank has an upper end that is open, the piston can be withdrawn out through the open top end and the pumpable compound can be poured, pumped or otherwise inserted into the tank through the open upper end.

* * * * *